US007007945B2

(12) United States Patent
Hiramitsu et al.

(10) Patent No.: US 7,007,945 B2
(45) Date of Patent: Mar. 7, 2006

(54) SEPARATION ROLL WEAR COMPENSATION DEVICE

(75) Inventors: Naruaki Hiramitsu, Kanagawa-ken (JP); Yoshihiko Naruoka, Kanagawa-ken (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 88 days.

(21) Appl. No.: 10/366,343

(22) Filed: Feb. 14, 2003

(65) Prior Publication Data

US 2003/0178763 A1 Sep. 25, 2003

(30) Foreign Application Priority Data

Mar. 20, 2002 (JP) ..... P2002-079141
Sep. 30, 2002 (JP) ..... 2002-286523

(51) Int. Cl.
*B65H 3/00* (2006.01)

(52) U.S. Cl. ..... 271/125; 271/265.01; 271/258.05; 271/122; 271/124

(58) Field of Classification Search ..... 271/265.01, 271/258.05, 121, 122, 123, 124, 125
See application file for complete search history.

(56) References Cited

U.S. PATENT DOCUMENTS 2,140,170 A 12/1938 Rouan
5,224,695 A 7/1993 Svyatsky et al.
5,342,037 A * 8/1994 Martin ..... 271/111
5,435,540 A * 7/1995 Martin et al. ..... 271/122
6,464,219 B1 * 10/2002 Yee et al. ..... 271/276
6,578,842 B1 * 6/2003 Hoberock ..... 271/117
6,616,511 B1 * 9/2003 Mori et al. ..... 451/49
6,672,579 B1 * 1/2004 Araki et al. ..... 271/122
2001/0020765 A1 9/2001 Araki et al.

FOREIGN PATENT DOCUMENTS

EP 000239161 B1 * 2/1993
JP 03-58984 6/1984
JP 2002-053234 2/2002

OTHER PUBLICATIONS

Yasuaki Ishii, "Development of FRR Paper Feed System," Ricoh Technical Report No. 12, Dec. 1984.
Patent Abstracts of Japan, JP2002053234A, vol. 2002, No. 06, Jun. 4, 2002.

* cited by examiner

*Primary Examiner*—Patrick Mackey
(74) *Attorney, Agent, or Firm*—Pillsbury Winthrop Shaw Pittman LLP

(57) ABSTRACT

A sheet take-out apparatus includes a pickup roller to send out sheets, a take-out roller to take out sheets sent out by the pickup roller, a separation roller pressure contacting the take-out roller to separate taken out sheets one by one by applying revolving torque in the direction reverse to the sheet take-out direction, a swing arm that is supporting the separation roller and swings according to change in the diameter of the separation roller, a detector to detect the position of the swing arm, and a controller to control revolving torque applied to the separation roller according to the detection result of the detector.

19 Claims, 14 Drawing Sheets

| COMMAND VALUE | DIAMETER OF SEPARATION ROLLER (mm) | TANGENTIAL FORCE F1 (N) | REVERSE TORQUE T (N·mm) | DRIVE CURRENT (A) |
|---|---|---|---|---|
| 1 | 25 | 2.5 | 62.5 | 0.75 |
| 2 | 24 | 2.5 | 60.0 | 0.70 |
| 3 | 23 | 2.5 | 57.5 | 0.65 |
| 4 | 22 | 2.5 | 55.0 | 0.60 |
| 5 | 21 | 2.5 | | * |

* ALARM FOR SEPARATION ROLLER ABRASION LIMIT

FIG. 8

SEPARATION ROLL WEAR COMPENSATION DEVICE

CROSS-REFERENCE TO RELATED APPLICATIONS

This application is based upon and claims the benefit of priority from the prior Japanese Patent Applications No. 2002-79141, filed on Mar. 20, 2002 and NO. 2002-286523, filed on Sep. 30, 2002: the entire contents of which are incorporated herein by reference.

BACKGROUND OF THE INVENTION

1. Field of the Invention

This invention relates to a sheet take-out apparatus that takes out accumulated sheets, for example, banknotes and the like by separating them one by one in a sheet sorting and arranging apparatus.

2. Description of the Related Art

As a sheet take-out apparatus of this type, for example, a friction type apparatus to take out sheets by a friction force of rubber rollers is known. In such a sheet take-out apparatus as this, it is demanded to be able to take out sheets by separating them surely without skewing. It is also desired that an apparatus is able to take out sheets stably without being affected by thickness and friction coefficient of sheets and further, in the case of banknotes, an apparatus is not affected by difference in kinds and sizes. On the other hand, from a viewpoint of processing capacity, an apparatus capable of taking out a large number of sheets within a unit time is desired.

As an apparatus to satisfy such demands, for example, a sheet take-out apparatus using separation rollers as disclosed in Japanese Patent Application No. 2002-53234, filed on Feb. 19, 2002 is developed. This sheet take-out apparatus comprises sending rollers to send out sheets from a supply portion, take-out rollers to take out the sheets sent out, and separation rollers kept in contact with the take-out rollers, and given with reversing torque in the direction reverse to the sheet take-out direction, separate sheets one by one.

However, this type of sheet take-out apparatus uses separation rollers that are given with a reverse torque in the direction reverse to the take-out direction of sheets and these separation rollers are worn away gradually. When the separation rollers are worn away, their diameters become small and tangential power in the reverse direction at a point where the separation rollers are in contact with the take-out rollers will become large. That is, the contacting pressure between the take-out rollers and the separation rollers decreases from a value that is optimum set for new rollers and the tangential power of the separation roller increase.

Originally, the separation rollers turn in the sheet conveying direction. However, by this change in the sheet separation condition, the number of turns decrease and the rollers are finally disabled to turn, and repeat the reversing and stopping. As a result, the number of sliding frictions generated with the separation rollers when taking out sheets will increase and the separation rollers are worn away at an accelerating pace and finally, disabled to take out sheets.

SUMMARY OF THE INVENTION

It is an object of the present invention to provide a sheet take-out apparatus that is capable of taking out sheets stably and certainly one by one for an extended period even when the diameters of the separation rollers are changed for abrasion, etc.

According to the present invention, a sheet take-out apparatus is provided. This apparatus comprises: a pickup roller to send out sheets; a take-out roller to take out the sheets sent out by the pickup roller; a separation roller that is pressure fit to the take-out roller and separates the sheets one by one by applying revolving torque in the direction reverse to the take-out direction of the sheets; a support member that is supporting the separation roller and move according to change in the diameter of the separation roller; a detector to detect position of the support member; and a controller to control revolving torque that is applied to the separation roller according to the result of detection by the detector.

Further, according to the present invention, a sheet take-out apparatus is provided, which comprises: a pickup roller to send out sheets; a take-out roller to take out the sheets sent out by the send-out roller by rotating them; a separation roller that is in pressure contact with the take-out roller and separates the sheets taken out one by one by applying revolving torque in the reverse direction to the take-out direction; a number of revolutions detector to detect the number of revolutions of the separation roller; and a controller to control revolving torque to be applied to the separation roller according to the result of detection by the number of revolution detector.

Further, according to the present invention, there is provided a sheet take-out method in a sheet take-out apparatus that has a pickup roller to send out sheets, a take-out roller to take out the sheets sent out by the pickup roller, and a separation roller that is in pressure contact with the take-out roller, comprising the steps of; detecting the diameter size of the separation roller that changes for abrasion; and controlling the revolving torque applied to the separation roller according to the detection result in the detecting step.

BRIEF DESCRIPTION OF THE DRAWINGS

FIG. 8 is a control data table showing driving current supplied to a motor according to change in the diameters of the separation rollers;

DETAILED DESCRIPTION OF THE INVENTION

Preferred embodiments of the present invention will be explained below referring to the attached drawings.

First, the first embodiment will be explained.

Figure 1:
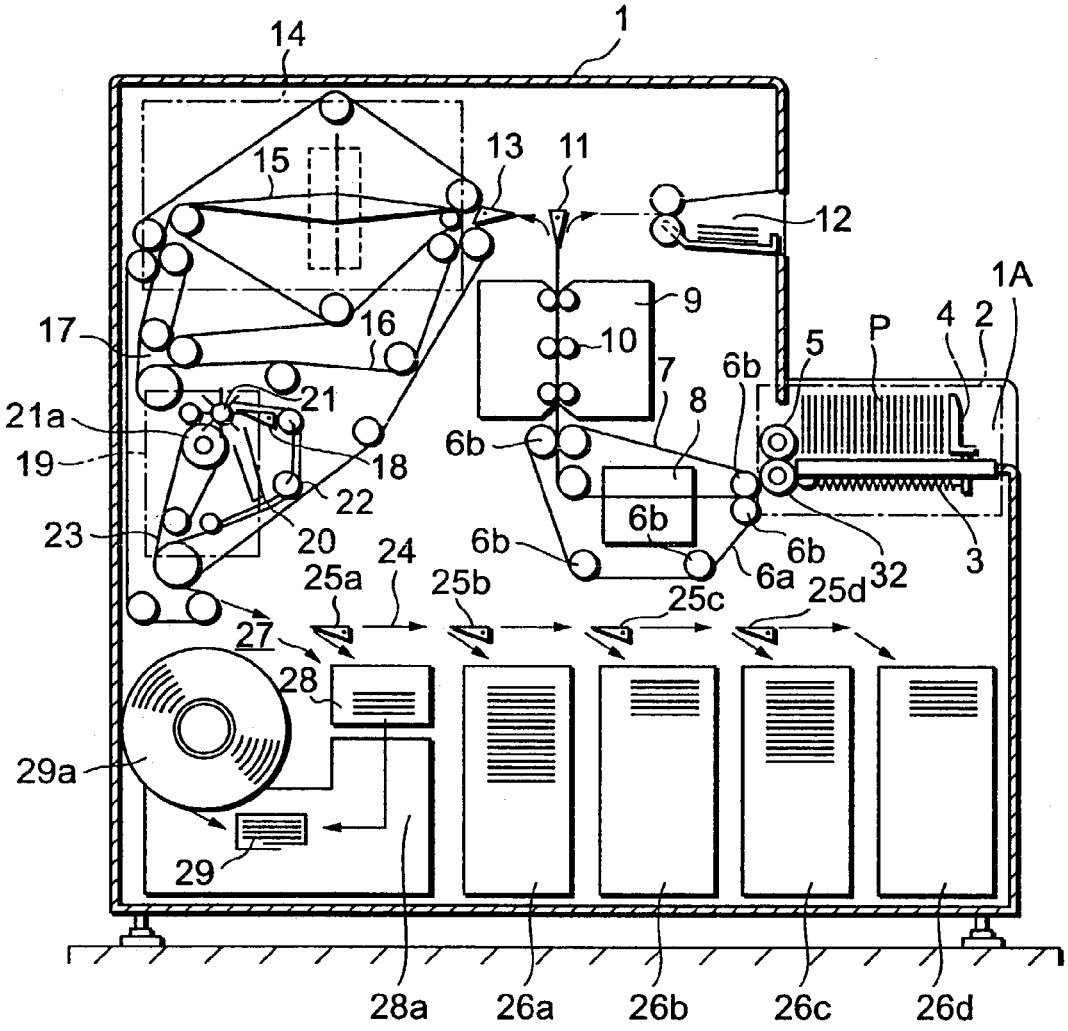
FIG. 1 is a typical internal construction diagram showing a banknote sorting processor equipped with a banknote take-out apparatus in a first embodiment of the sheet take-out apparatus of the present invention.

FIG. 1 is a typical internal construction diagram showing a banknote sorting processor involved in the first embodiment. At the one side central portion of a housing 1, there is provided a table portion 1A. This table 1A is provided with a banknote supply portion 2. Plural banknotes P is housed in the banknote supply portion 2 in the erected state. The banknotes P are pushed against pickup rollers 5 that are sending rollers by a backup plate 4 that is a push-in means biased by a spring 3. Thus, the banknotes P is sent out downward when the pickup rollers 5 are rotated. Below the pickup rollers 5, there are arranged a separation portion 32 comprising a sheet take-out apparatus that is described later in detail and a conveying portion 37 (shown in FIG. 2).

Banknotes P taken out from the conveying portion 37 are conveyed by a clamping type conveying unit 7 composed of a belt 6*a* and plural rollers 6*b*. The conveying unit 7 is provided with a posture correction device 8 that automatically corrects the shift and skew of taken out banknotes P. As the posture correction device 8, for example, a posture correction device disclosed in U.S. patent application Ser. No. 09/899,851, filed on Jul. 9, 2001 can be applied. At the downstream side in the banknote conveying direction of the conveying unit 7, there is a discriminator 9. This discriminator 9 reads out various data from the surface of a banknote P being conveyed on a roller pair 10. Further, the discriminator 9 discriminates banknotes taken in two sheets, presence of stain, tear or break, kind of banknote, four directions of top, bottom, front and back by the logical operations of various data and comparison of the data obtained by the logical operations with data that become reference.

At the downstream side in the banknote conveying direction of the discriminator 9, there is provided a first gate 11 that functions as a switching means. This first gate 11 that is a switching means leads banknotes that cannot be discriminated as proper banknotes P, for example, banknotes taken in two sheets at a time, banknotes that are skewed over a specified level to an rejection box 12. The first gate 11 leads banknotes that are judged to be proper banknotes to a second gate 13 that is a switching means.

The second gate 13 branches the conveying direction of banknotes into first and second directions. In the first direction, there is provided with a both sides reversing path 14. This both sides reversing path 14 has a twist belt 15 that reverses banknotes by 180° in the left and right directions. The front and back reversing device disclosed in Japanese Patent Application No. 1991-58984 (Published on Sep. 9, 1991) is applicable. In the second direction, there is provided a simple belt conveyor 16 that conveys banknotes P in the as is state. The banknotes branched and conveyed in the first and second directions are jointed in a joining portion 17. The path lengths of the first and second directions to the joining portion 17 are equal to each other and a space between banknotes in both baths is not shifted after joined.

At the downstream side in the banknote conveying direction of the joining portion 17, there is a third gate 18 that is a switching means. The conveying direction of banknotes P is branched into third and fourth directions by this third gate 18. In the third direction, a switchback path portion 19 is provided. This switchback path portion 19 is provided with a reversing box 20 that introduces banknotes P and a tapping wheel 21 that pushes the rear ends of the banknotes P led into the reversing box 20 against a reversing roller 21*a*. When the banknotes P are sent out from the reversing box 20, their tops and bottoms are reversed and conveyed in that state.

In the fourth direction, a simple belt conveyor 22 is provided and banknotes P are conveyed while being kept in that posture. The banknotes branched and conveyed in the third and fourth directions are joined in the joining portion 23. The lengths of the branch paths are kept the same up to the joining portion 23 are equal and a space between the joined banknote groups is not shifted.

At the downstream side in the banknote conveying direction of the joining portion 23, a horizontal conveying path 24 is provided. In this horizontal conveying path 24, gates 25*a*–25*d* in the number less than the number of portions to be divided by one are arranged. Under the gates 25*a*–25*d*, first through fourth stackers 26*a*–26*d* are arranged as banknote stackers. Banknotes P are stacked in the horizontal state in the stackers 26*a*–26*d*.

Below the first gate 25*a*, a banding device 27 is provided. This banding device 27 has a stacker 28 that sorts and stacks banknotes P by 100 sheets, a conveying portion 28*a* to convey banknotes from the stacker 28 and a winding portion 29 that winds banknotes P conveyed by the conveying portion 28*a* with a paper strip 29*a*.

Figure 2:
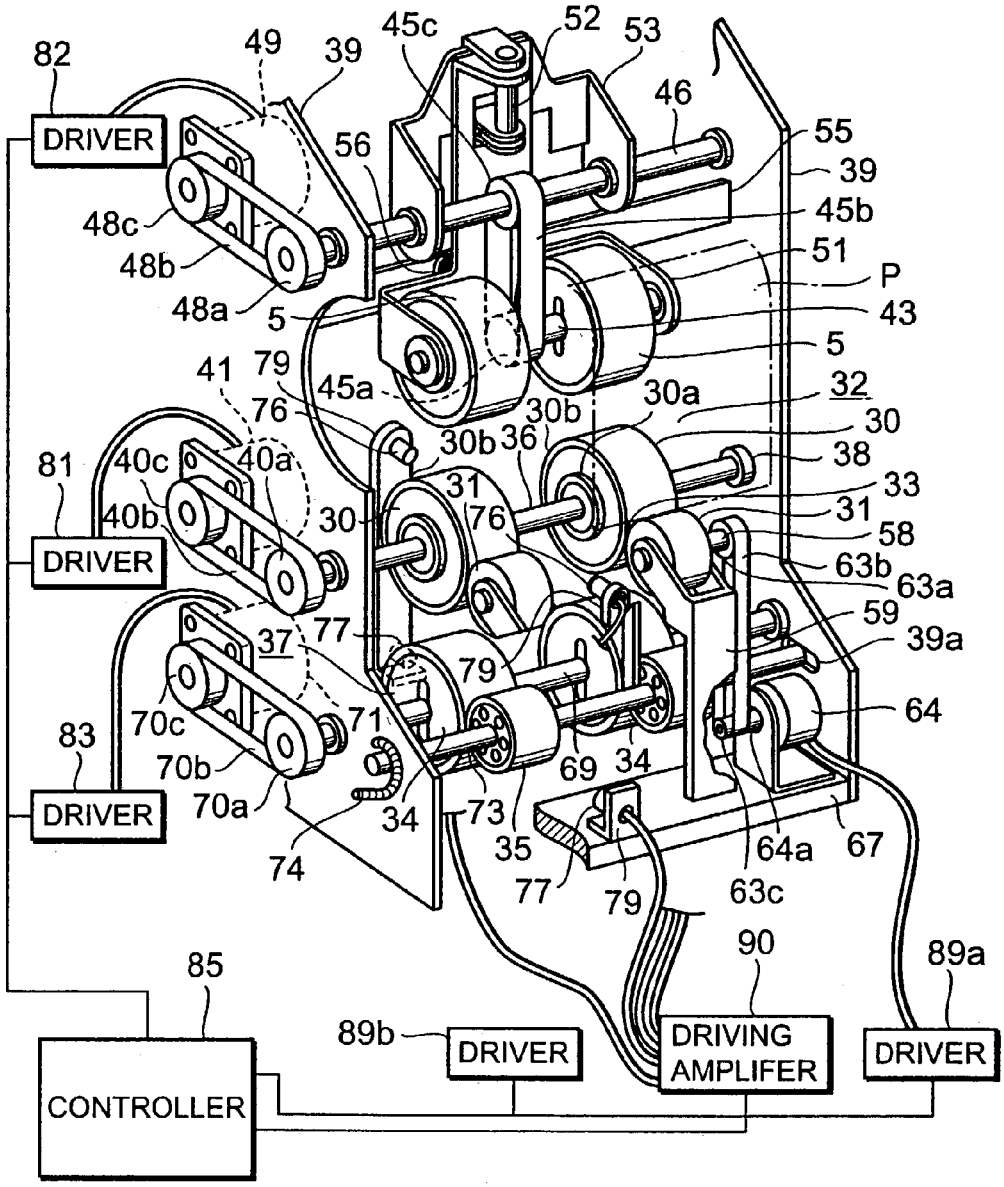
FIG. 2 is a perspective view of the banknote take-out apparatus with the detailed construction shown.

FIG. 2 shows the construction of a banknote take-out apparatus that is a sheet take-out apparatus. This banknote take-out apparatus is composed of pickup rollers 5 and 5, separation portion 32 and conveying portion 37. The pickup rollers 5 and 5, separation portion 32 and conveying portion 37 are arranged along the vertical direction.

The separation portion 32 is equipped with take-out rollers 30 and 30. Separation rollers (reversing rollers) 31 and 31 are pushed against the take-out rollers 30 and 30. The conveying portion 37 is located below the take-out rollers 30 and 30 and is provided with driver rollers 34 and 34 that are conveying rollers. Pinch rollers 35 and 35 that are also conveying rollers are kept in contact with the driver rollers 34 and 34. Banknotes P are pulled out and conveyed by the driver rollers 34 and 34 and the pinch rollers 35 and 35. One each of the pickup roller 5, take-out roller 30, separation roller 31, driver roller 34 and pinch roller 35 are arranged at the left and right sides, and banknotes P are taken out along the shorter direction.

A rubber layer 36*b* is formed on the peripheral surfaces of the take-out rollers 30 of the separation portion 32, and the take-out rollers are mounted to a shaft 36 through a one-way clutch 30*a*. The take-out rollers 30 are able to rotate freely in the banknote P take-out direction so as to reduce resistance when banknotes P are pulled out by the driver rollers 34 and pinch rollers 35. The shaft 36 is mounted to frames 39 through a bearing 38. A take-out motor 41 is connected to one end of the shaft 36 through the pulley 40*a*, timing belt 40*b* and pulley 40*c*.

Further, in this embodiment the one-way clutch was provided to the take-out roller 30*a*. However, the take-out rollers may be fixed to the shaft 36, the one-way clutch 30*a* can be provided to the timing pulley 40*a* so that it is able to turn between the shaft 36 and the pulley 40*a*.

A shaft 43 of the pickup roller 5 is connected to a shaft 46 through a pulley 45*a*, timing belt 45*b* and pulley 45*c*. The shaft 46 are supported at both ends by frames 39 and 39. A pickup motor 49 is connected to one end of the shaft 46 through a pulley 48*a*, timing belt 48*b* and pulley 48*c*. The shaft 43 is mounted to a bracket 51 rotatably and the bracket 51 is mounted to a bracket 53 through a shaft 52.

The bracket 53 is attached to the frames 39 and 39 through the shaft 46 and is able to rotated to the left and right. Between the bracket 51 and a stay 55, a compression spring is provided. Thus, the pickup rollers 5 and 5 provided at the left and right sides to generate uniform pushing force to banknotes P by slightly changing the positions horizontally as well as vertically.

Figure 7:
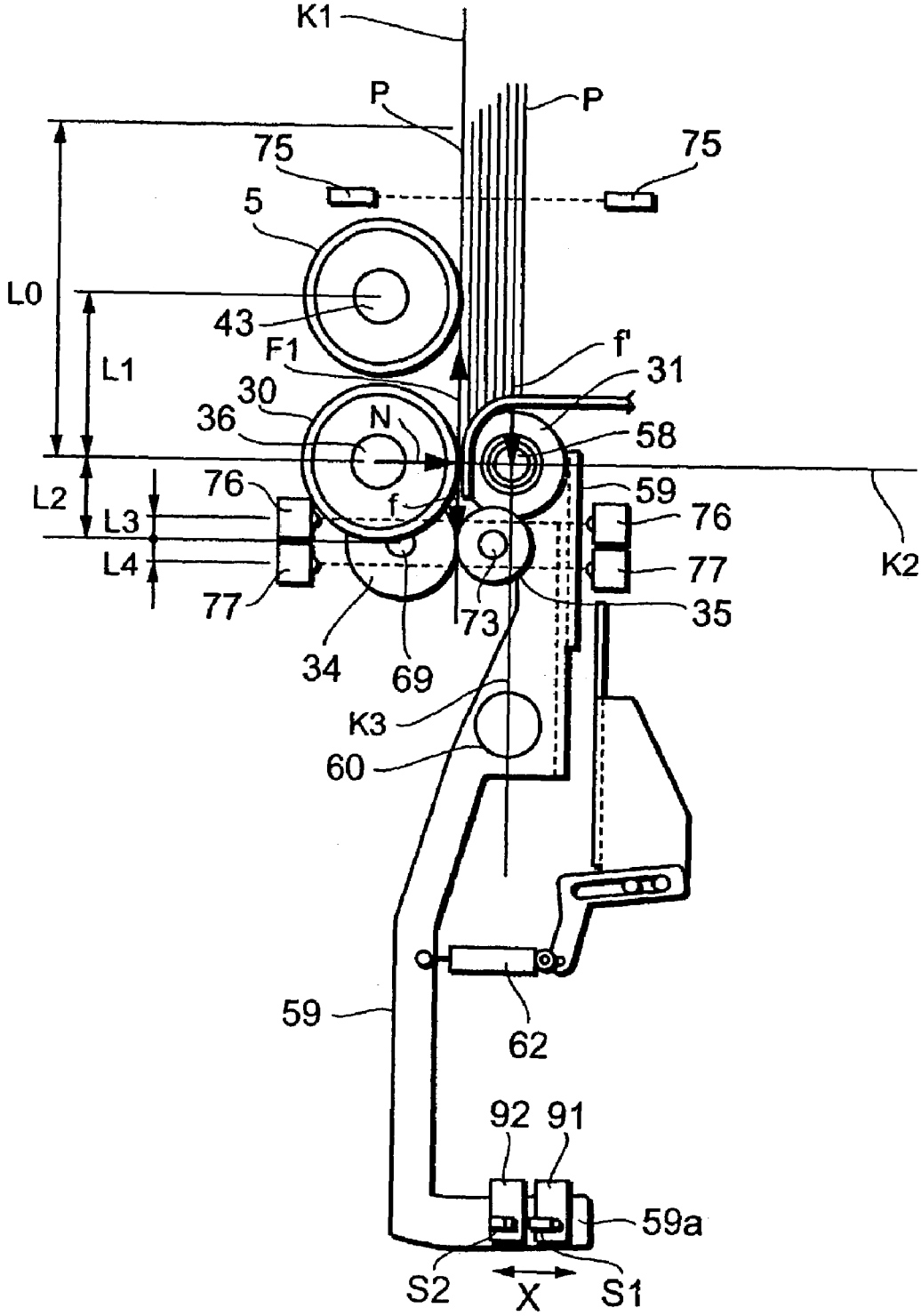
FIG. 7 is a side view showing the details of a swing arm and arrangement of the rollers and detectors in the banknote take-out apparatus in the first embodiment.

All peripheral surfaces of the separation rollers 31 are formed by rubber and a friction coefficient used for the separation rollers 31 to banknotes P is higher than that between banknotes P. The separation roller 31 is installed rotatably to the top of a swing arm 59 that is a supporting member through a shaft 58. The mid portion of the swing arm 59 is supported by a shaft 60 that is a supporting portion (FIG. 7). The swing arm 59 is biased by a spring 62 (FIG. 7) and pushes the separation roller 31 against the take-out roller 30. Further, the swing arm 59 will be explained later in detail using FIG. 7.

To a shaft 58 of the separation roller 31, a reverse motor 64 is connected through a pulley 63*a*, timing belt 63*b* and pulley 63*c*. The reverse motor 64 rotates the separation roller 31 in the reverse direction to the take-out direction of banknotes P. As described later, the separation roller 31 rotates in the take-out direction jointly with the take-out roller 30 but the reversing torque is applied in the reverse direction and generates a separation force to banknotes P.

The pitch diameter of the timing pulley 63*a* fixed to the shaft 58 of the separation roller 31 is the same as that of the timing pulley 63*c* attached to a drive shaft 64*a* of the reverse motor 64. Further, the reverse motor 64 is fixed to a stay 67 so that the shaft center of the shaft 60 of the swing arm 59 is positioned on the shaft center of its drive shaft 64*a*.

The driver rollers 34 swing by the frames 39 and 39 through the shaft 69. The shaft 69 is connected to a conveyor motor 71 through a pulley 70*a*, a timing belt 70*b* and a pulley 70*c*. The pinch rollers 35 are supported rotatably by a shaft 73. Both ends of the shaft 73 are supported by horizontal slits 39*a* of the frames 39 and 39 and are biased by a spring 74. By this biasing, the pinch rollers 35 are pushed against the driver rollers 34 and generate a conveying force.

Between the take-out rollers 30 and the drive rollers 34 and the pinch rollers 35, a first detector 76 is provided as a detecting means for detecting banknotes P sent out from the take-out rollers 30 and the separation rollers 31. Bear the take-out side of the driver rollers 34 and the pinch rollers 35, a second detector 77 is provided as a second detecting means to detect banknotes P sent out from the driver rollers 34 and the pinch rollers 35. The first and second detectors 76 and 77 are, for example, light transmission type light sensors and attached to a bracket 79, respectively. Further, near the pickup rollers 5 of the banknote supply portion 2, there is provided a third detector that is an optical detector for detecting presence of banknotes P in the banknote supply portion 2.

The optical axis of the first detector 76 passes through the conveying path between the contacting portion of the take-out roller 30 and the separation roller 31 and the contacting portion of the driver roller 34 and the pinch roller 35. The optical axis of the second detector 77 passes through the conveying path immediately after the contacting portion of the driver roller 34 with the pinch roller 35.

To the take-out motor 41, pick-up motor 49 and conveying motor 71 are connected with drivers 81, 82 and 83 are connected, respectively. The drivers 81, 82 and 83 are connected to a controller 85, respectively. Further, the take-out motor 41 and the pick-up motor 49 require the intermittent drive control and a pulse motor is used for this purpose.

Drivers 89*a* and 89*b* are connected to the left and right reverse motors 64. The drivers 89*a* and 89*b* are connected to a controller 85, respectively. The reverse motor 64 is a DC motor capable of controlling driving current and is able to obtain required generating torque by setting a driving current value. A driving amplifier 90 is connected to the first and second detectors 76 and 77 for detecting the passage of banknotes and sends this information to the controller 85.

FIG. 3–FIG. 6 are typical diagrams of the separation portion 32 showing the principle of generating the separation force.

Figure 3:
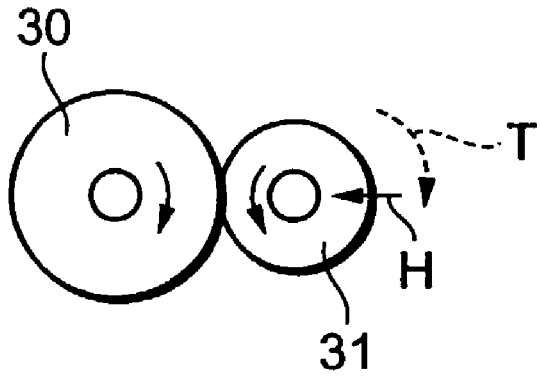
FIG. 3 is a diagram showing the revolving state of the take-out rollers and separation rollers comprising the separation mechanism of the banknote take-out apparatus shown in FIG. 2.

FIG. 3 shows that there is no banknote P between the take-out roller 30 and the separation roller 31, and the separation roller 31 is rotating in the conveying direction with the rotation of the take-out roller 30. The separation roller 31 is pushed against the take-out roller 30 by a prescribed pushing pressure H and is applied with a reversing torque T by the reverse motor 64. However, as the torque applied by tangential force that is a friction force with the take-out roller 30 is higher than the reversing torque, the reversing motor 64 slips and the separation roller 31 is rotating in the conveying direction.

Figure 4:
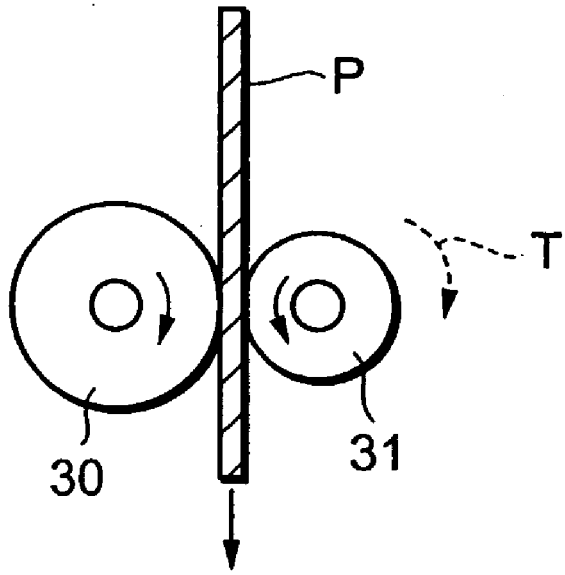
FIG. 4 is a diagram showing the state wherein one sheet of banknote is supplied between the take-out roller and the separation roller.

Next, FIG. 4 shows that one sheet of banknote P is between the take-out roller 30 and the separation roller 31. As the reversing torque T is set smaller than the torque applied to the separation roller 31 by the tangential force generated by the friction force between a banknote P and the separation roller 31, the separation roller 31 is rotating in the conveying direction through the banknote P.

Figure 5:
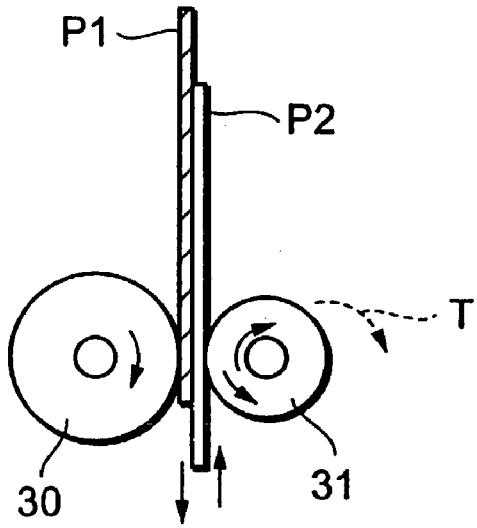
FIG. 5 is a diagram showing the state where two sheets of banknotes is fed between the take-out roller and the separation roller.

Next, FIG. 5 shows a case wherein two sheets of banknote P are present between the take-out roller 30 and the separation roller 31. As a friction force generated between banknotes P1 and P2 is small, a torque of the reverse motor 64 is higher and the separation roller 31 begins to reverse in the conveying direction.

Figure 6:
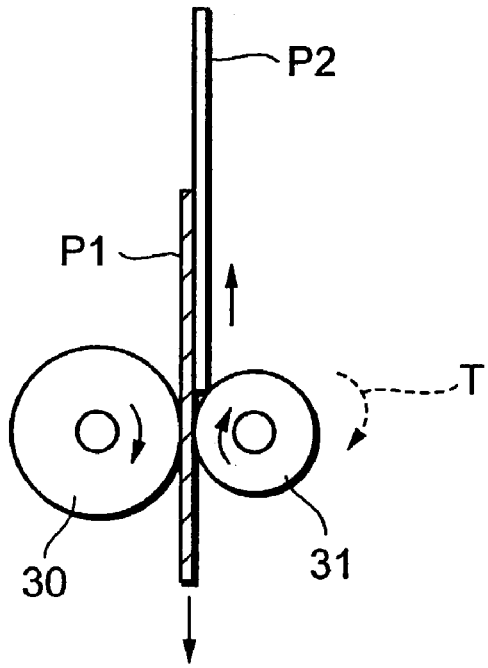
FIG. 6 is a diagram showing the state wherein two sheets of banknotes supplied between the take-out roller and the separation roller are separated.

Then, FIG. 6 shows the state wherein the second banknote P2 is pulled back by the reverse rotation of the reverse motor 64. The state shown in FIG. 6 is almost the same as the state shown in FIG. 4 and the first banknote P1 is conveyed. Thus, even when trying to take out two sheets of banknote P, the second banknote P2 is pulled back and the first banknote P1 only is taken out. Actually, the state shown in FIG. 5 and the state shown in FIG. 6 are repeated whenever the first banknote P1 is taken out and banknotes P are separated one by one and taken out.

The tangential force applied to the second banknote P2 from the separation roller 31 acts as a separation power. From these tangential force and pressure power, an apparent friction coefficient of the separation roller becomes a pushing pressure of (a reversing torque/a radius of a separation roller)/the separation roller. AS the pushing pressure of the separation roller 31 is constant by the spring power, an apparent friction coefficient of a reversing torque can be maintained constant by controlling a reversing torque constant and a stabilized separation power can be provided.

Further, an apparent friction coefficient can be set at any level by changing a reversing torque. Friction coefficients of the take-out roller 30 and the separation roller 31 higher than that between banknotes P1 and P2 are preferred. If the friction coefficients of the take-out roller 30 and the separation roller 31 are high, it is possible to maintain sending and separation powers at a stabilized level.

It is not necessary to maintain the friction coefficient of the separation roller 31 at a medium level like the gate roller and the material selecting range of the roller becomes wider. Further, the separation roller 31 does not always generate a slip with banknotes P like the gate roller and principally, there is no slip with banknotes P and therefore, it is advantageous as far as abrasion resistance is concerned. Actually, the separation roller 31 causes the slip against the take-out roller 30 and banknotes P. It is preferred to select durable materials by taking this into consideration.

FIG. 7 shows the details of the swing arm 59 and the layout of rollers in a banknote take-out apparatus.

As stated above, the separation roller 31 is mounted rotatably on the top of the swing arm 59 through the shaft 58 and the middle portion of the swing arm 59 is supported rotatably by the shaft 60 that is a supporting portion on the same straight line as the center of the rotary shaft of the separation roller 31. The swing arm 59 pushes the separation roller 31 against the take-out roller 30 as compressed by the spring 62. In this construction, the swing arm 59 swings in the arrow direction X (the horizontal direction orthogonal to the conveying direction) with the shaft 60 as a supporting point according to the change in a diameter of the separation roller 31.

At the lower end (the top) of the swing arm 59, there is a long slit portion 59*a* formed in its swing direction X. On this slit portion 59*a*, plural long slit holes (transparent holes, two pieces in this embodiment) S1 and S2 provided side by side in the swing direction X at a prescribed space. The slit holes S1 and S2 are used for detecting the position of the swing arm 59.

Near the position opposing to the slit portion 59*a* of the swing arm 59, plural (two pieces in this embodiment) detectors 91 and 92 are provided side by side in the swing direction at a prescribed space. The detectors 91 and 92 are composed of a light source and a light receiving element provided opposing to each other with the slit portion 59*a* put between them. When the swing arm 59 swings, the light axes of the detectors 91 and 92 cross or cut off the slit holes. The outputs of the detectors 91 and 92 are supplied to the controller 85 (FIG. 2) through the driving amplifier 90 (FIG. 2).

Figures 9A, 9B, 9C, 9D:
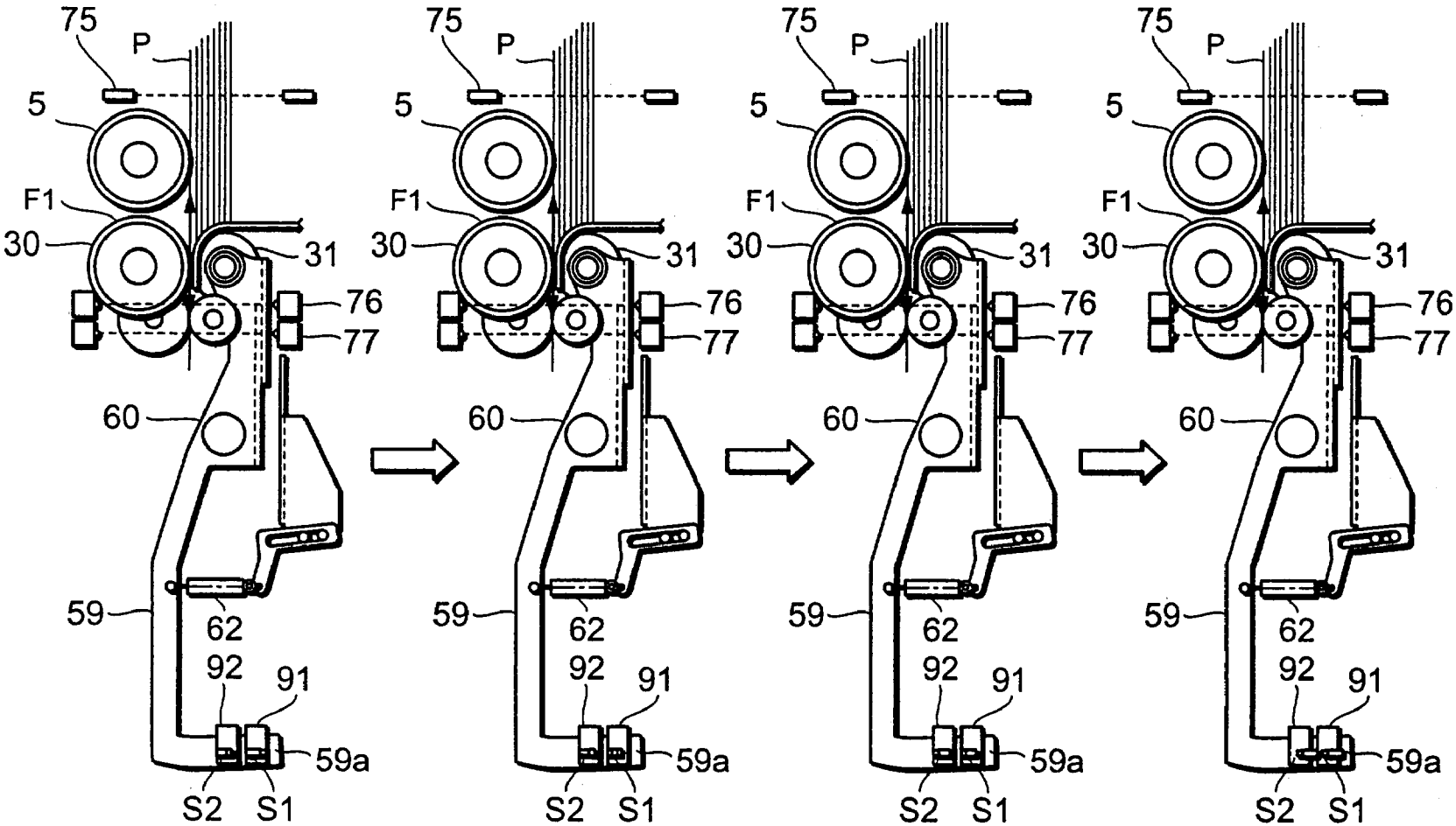
FIG. 9A–FIG. 9D are side views showing the layouts of the rollers and the position of the swing arm corresponding to the change in the diameters of the separation rollers in the first embodiment.

In this construction, when the swing arm 59 swings, the detecting state of the detectors 91 and 92 change as shown in FIG. 9A–FIG. 9D. That is, when the separate roller 31 is a new product, the light axis of the detector 91 was cut off by the slit portion 59*a* and the light axis of the detector 92 crossed the slit hole S2 as shown in FIG. 9A. When the diameter of the separation roller 31 is reduced by abrasion, etc., the light axes of the detectors 91 and 92 cross the slit holes S1 and S2 as shown in FIG. 9B. When the separation roller 31 is further worn away and its diameter decreased, the light axis of the detector crossed the slit hole S1 and the light axis of the detector 92 is cut off at the slit portion 59*a* as shown in FIG. 9C. When the diameter of the separation roller 31 further decreases, the light axes of the detectors 91 and 92 are cut off by the slit portion 59*a* as shown in FIG. 9D.

Thus, by providing two detectors 91 and 92, it is enabled to detect changes in the diameter of the separation roller 31 in four stages. Then, as described later, driving current values of the motor 64 optimum at respective stages are predetermined and a control data table is prepared. By supplying the driving current of an optimum value to the motor 64 from the control data table corresponding to the detection results of the detectors 91 and 92, it becomes possible to maintain the optimum separation condition even when the diameter of the separation roller 31 changes. That is, even if the separation roller is worn away, it becomes possible to take out sheets one by one stably and certainly for an extended period by changing a reversing torque of the separation roller 31.

The control data table is composed of correlation among command value, diameter of the separation roller, tangent power, reversing torque and driving current as shown in FIG. 8. That is, in order to maintain tangential force always constant even when the diameter of the separation roller decreases, current to be supplied to the motor 64 is selected step by step so as to decrease a reversing torque that is given to the separation roller 31. According to this control data table, the diameter of a new separation roller 31 is 25 mm and the driving current supplied to the motor 64 is 0.75 A. so, when the detectors 91 and 92 detect the reduced diameter of the separation roller 31 down to 23 mm for abrasion as a result of use for an extended period, current of 0.65 A corresponding to the command value 3 is supplied to the motor 64 so as to give a reversing torque 57.5N to the separation roller 31. In other words, with the decrease in the diameter of the separation roller 31, a current value supplied to the motor 64 is made small. Then, when the diameter of the separation roller 31 is reduced to 21 mm for abrasion, an alarm to the operating portion is generated to inform operator of the limit for the normal use of the separation roller 31 and its exchanging period.

The pickup rollers 5 are in contact with banknotes P pressed by the backup plate, supply the banknotes P into the separation portion 32 and take out the banknotes P in cooperation with the take-out rollers 30. The reversing torque is applied to the separation rollers 31 during the take-out operation but when there is no banknote P, the reversing torque is so set to rotate the separation rollers 31 with the rotation of the take-out rollers 30. In the friction force separation mechanism, it is necessary to stably give a pressing force and a reversing torque generated by the motor 64 to the separation roller 31.

By the way, in order to obtain stabilized pressing power without being affected by banknote P and generated torque, the layout of rollers is important and the following points are taken into consideration. That is, supposing a segment of line connecting the portion of the pickup roller 5 contacting a banknote P and a contacting portion 33 between the take-out roller 30 and the separation roller 31 as K1, a segment of line connecting the center of rotary shaft of the take-out roller 30 and the center of the rotary shaft of the separation roller 31 as K2, and a straight line connecting the center of the rotary shaft of the separation roller 31 and the center of the rotary shaft of the swing arm 59 as K3, the segments of lines K1 and K2 are crossing at an angle of about 90°.

That is, the direction of common tangent line of the take-out roller 30 and the separation roller 31 becomes the conveying direction of banknotes P. This is to make it easy to send banknotes P to the contacting portion 33 of the take-out roller 30 and the separation roller 31 and to suppress resistance applied to the banknote P returned by the separation roller 31 from piled up banknotes P.

The line segments K2 and K3 are also crossing at an angle of about 90°. This is to prevent the friction power generated in the separation portion 32 to give an effect to the pushing pressure of the separation roller 31. The moment generated in the separation roller 31 by the friction force f acting on the surface of the separation roller 31 is balanced with a torque of the reverse motor 64 connected through a timing belt 63*b*. After all, it acts to the swing arm 59 as a force f' in the same size as the friction force f through the shaft 58.

When the crossing angle of the line segment K2 with the line segment K3 is maintained at 90°, the vector of the force f' passes the center of the rotary shaft 60 and therefore, the swing arm 59 is not rotated. Accordingly, the pushing pressure N generated in the contacting portion 33 between the take-out rollers 30 with the separation roller 41 can be maintained at a constant level. In addition, it is also a point to fix the reverse motor 64 to a stay 67 and not to allow the swing arm 59 to swing together with the separation roller 51.

Here, the contacting pressure between the take-out roller 30 and the separation roller 31 is determined by a spring force of a spring 62 and its mounting position and becomes constant without subject to the effect of the friction force on the roller surface.

Further, in FIG. 7, LO is a length of banknote P in the shorter direction (the length of conveying direction), L1 is a distance between the center of the rotary shaft of the pickup roller 5 and the center of the rotary shaft of the take-out roller 30, L2 is a distance between the center of the rotary shaft of the take-out roller 30 and the center of the rotary shaft of the driver roller 34, L3 is a distance between the installed point of the first detector 76 and the center of the rotary shaft of the driver roller 34, L4 is a distance between the center of the rotary shaft 69 of the driver roller 34 and the installed point of the second detector 77, and N is a pushing pressure in the contacting portion 33 between the take-out roller 30 and the separation roller 31.

Figure 10:
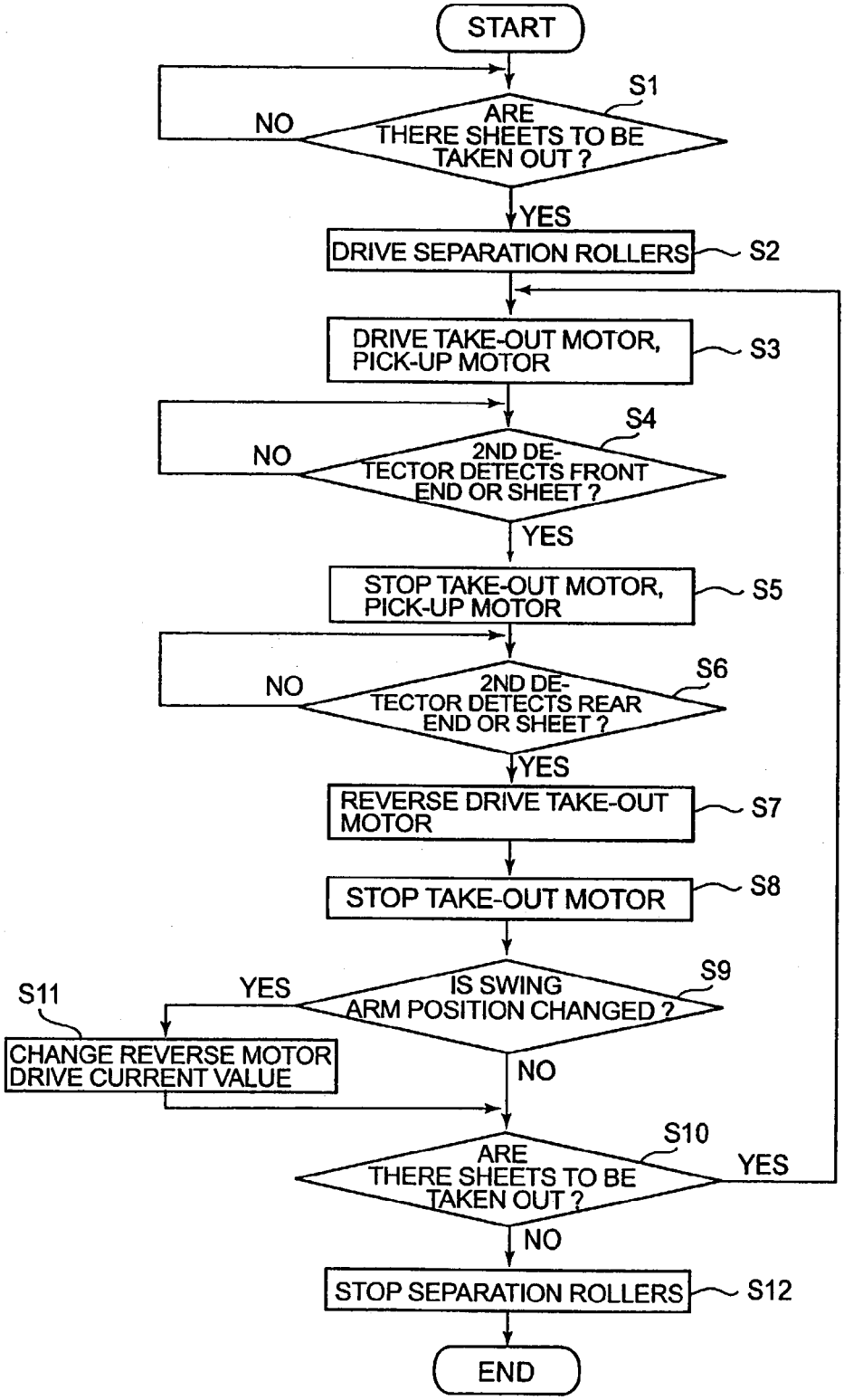
FIG. 10 is a flowchart for explaining the banknote take-out operation in the first embodiment.

Next, in the construction described above, the banknote take-out operation will be explained referring to a flowchart shown in FIG. 10. When the take-out of banknotes P starts, it is judged if there are banknotes P to be taken out in the banknote supply portion 2 based on the output signal from the third detector 75 (Step S1). As a result of the judgment, when there are banknotes P to be taken out, the separation rollers 31 are driven to rotate in the reverse direction by the reverse motor 64 (Step S2). As the take-out rollers 30 are kept stopped at this time, the separation rollers 31 will not be rotated by a resisting force from the take-out rollers 30. Then, the take-out motor 41 and the pick-up motor 49 are drive to rotate (Step S3) and the take-out of banknotes P starts.

Then, the controller 85 judges whether the front end of the first taken out banknote P passed the take-out rollers 30 and was detected by the second detector 77 (Step S4). When the second detector 77 detects the front end of the banknote P, the take-out motor 41 and the pick-up motor 49 are stopped to run (Step S5). The take-out roller 30 rotates the banknote P conveyed by the driver rollers 34 even when the take-out motor 41 stops to run and does not give resistance to the first banknote P as it has a built-in one-way clutch 30*a*. After the front end of the first banknote P arrives at the second detector 77, the rear end of the banknote P comes off the pick-up rollers 5.

Further, when banknotes P are long and the front end of the first banknote P is still on the pickup rollers 5, it acts on the first banknote P as resistance. However, as the pushing pressure on the driver rollers 34 and the pinch rollers 35 is set larger than the pushing pressure of the pickup rollers 5 to banknotes P, the banknote P slips on the pickup rollers 5 and is conveyed. When the first banknote P comes off from the pickup roller 5 and the second banknote contacts the pickup rollers 5, the pickup rollers 5 act to the second banknote as a brake and the rotation of the banknote P is prevented. That is, the take-out of plural sheets of banknote P is prevented.

Then, the controller 58 judges whether the rear end of the first banknote P being conveyed is detected by the second detector 77 (Step S7). When the second detector 77 detects the read end of the first banknote P, the controller 58 drives the take-out motor 41 to rotate in the reverse direction (Step S7). At this time, the take-out rollers 30 is rotated in the reverse direction by the friction force with the separation rollers 31 which are rotating in the reverse direction as the take-out rollers 30 are mounted to the shaft 36 through the one-way clutch 30*a*. That is, the take-out rollers 30 and the separation rollers 31 are rotated slightly in the reverse direction.

At this time, the controller 85 controls the take-out motor 41 to rotate the take-out rollers 30 by a predetermined angle, that is, an angle that cannot divide 360°, for example 7°. With the rotation of the take-out rollers 30, the separation rollers 31 are rotated similarly by the predetermined angle.

Thus, by rotating the separation rollers 31 by a predetermined angle that cannot divide 360°, it is possible to prevent the biased abrasion of the separation rollers 31 and the stabilized separation is enabled for an extended period.

The controller 85 stops the take-out motor 41 to run after rotating the take-out rollers 30 by a predetermined angle by controlling the take-out motor 41 (Step S8).

Then, the controller 85 judges whether the position of the swing arm 59 changes according to the output signals from the detectors 91 and 92 (Step S9) and if there is no change, proceeds to Step S10. If the position of the swing arm 59 changed, the controller 85 changes the driving current of the reverse motor 64 to an optimum value (Step S11) and proceeds to Step S10.

Here, the driving current value changing method of the reverse motor 64 in Step S11 will be explained concretely. For example, the control data table shown in FIG. 8 prestoring optimum driving current values at 4 stage position of the swing arm 59 detected by the detectors 91 and 92; that is, diameters of the separation rollers 31 at 4 stages is stored in a memory (not shown) in the controller 85. An optimum driving current value corresponding to the detection result of the detectors 91 and 92 is taken out of the control data table and the taken out driving current value is set as a driving current value of the reverse motor 64. The explanation of the control data table is omitted here as it is described former referring to FIG. 8.

Now, in Step S10, the controller 85 discriminates whether there are banknotes P in the banknote supply portion 2 based on the output signal from the third detector 75. When it is judged that there are banknotes P as a result of this discrimination, the controller 85 returns to Step S3 and begins to take a second banknote P. When it is discriminated that there is no banknote P, the separation roller 31 (the reverse motor 64) is stopped (Step S12). Thereafter, all motors are stopped to run and the take-out operation is terminated.

Thus, after taking out one sheet of banknote, the position of the swing arm 59 is detected (the diameter detection of the separation rollers 31 and if the position (the diameter) is not changed, the operation proceeds to the next banknote take-out step. If the position (the diameter) is changed, the motor 64 driving current value is changed to the pre-set value according to the detected position (the diameter) of the swing arm 59 and the operation proceeds to the next banknote take-out step.

Figure 11:
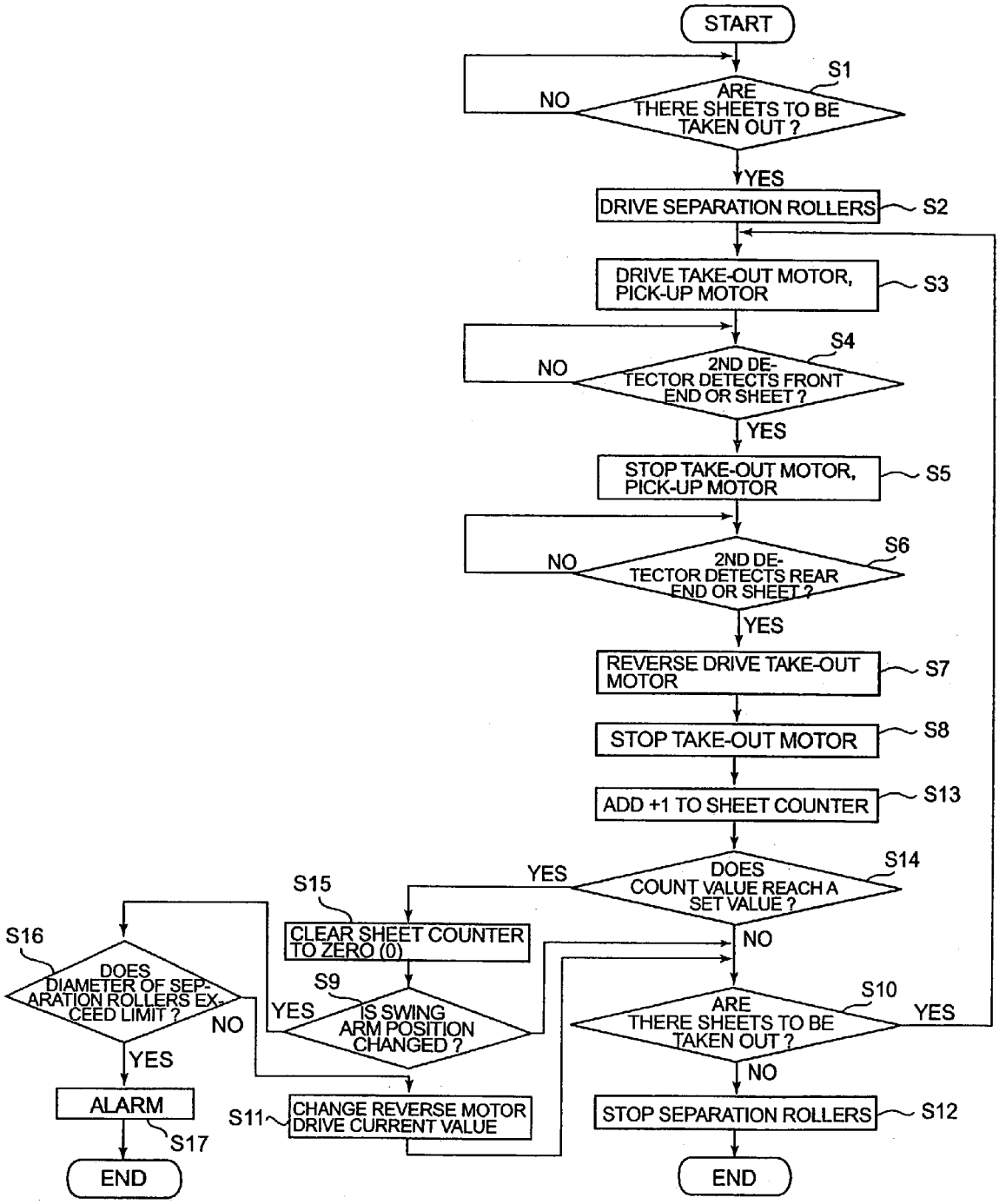
FIG. 11 is a flowchart for explaining the deformed example of the banknote take-out operation in the first embodiment.

Further, it is not necessary to detect the position of the swing arm 59 whenever one sheet of banknote is taken out but the position may be detected when the pre-set numbers of banknotes are taken out. In this case, the banknote take-out operation will become as shown in the flowchart in FIG. 11. The flowchart shown in FIG. 11 differs from the flowchart shown in FIG. 10 in that the processes in Steps S13–S15 are added between Step S8 and S9 in the flowchart in FIG. 10 and all others are the same as those shown in FIG. 10. The processes in Steps S13–S15 will be explained below.

In Step S13, a sheet counter (not shown) that is a means to count the number of banknotes P taken out is increased by [+1]. In Step S14, whether a count value of the sheet counter reaches a preset predetermined value is discriminated and if the count value is not a predetermined value, the operation proceeds to Step S10 and when the count value reaches a predetermined, proceeds to Step S15. In Step S15, after clearing the sheet counter to "0", the operation proceeds to Step S9.

In the operations as described above, the position of the swing arm 59 (the diameter of the separation roller 31) can be detected whenever a preset number of banknotes is taken out.

Further, when the change in the position of the swing arm 59 is detected in Step S9, whether the limit of the diameter of the separation roller 31 is exceeded is checked in Step S16. When this check finds that the limit is reached, the operation proceeds to Step S17. For example, when the diameter of the separation roller 31 reaches 21 mm as shown in the control data table in FIG. 8, operator is warned in Step 17 as the function of the separation roller 31 as the separation roller reaches the limit by the abrasion.

Further, when no change in the position of the swing arm 59 is detected in Step S9, the operation proceeds to Step S10.

As explained above, according to the first embodiment, even when the diameter of the separation roller 31 is changed for abrasion, it is possible to take out banknotes P one by one stably and certainly for an extended period.

That is, as described above, even when one-sided abrasion of the separation rollers 31 can be prevented, abrasion of the separation rollers can not be eliminated and the diameter of the separation roller 31 becomes small with the progress of abrasion. The layouts of the rollers when the diameters of the separation rollers 31 become small are shown in FIG. 8A–FIG. 8D. When compared with FIG. 7, the swing arm 59 is tilted with the supporting point 60 as the center corresponding to the reduced diameter of the separation roller 31.

As a result, the contacting pressure between the take-out roller 30 and the separation roller 31 is reduced by the reduced amount of the mounting length of the spring 62. Further, a torque generated on the separation roller 31 is given by a torque of the reverse motor 64 connected through a timing belt 63*b*. Accordingly, a tangential force F1 in the reverse direction at the point of the separation roller 31 contacting the take-out roller 30 will be:

$$F1=T\cdot e/a$$

where T is a torque of the reverse motor 64, e is a pitch radius of the timing pulley 63*c* and a is a radius of the separation roller 31.

From this equation, when the separation roller 31 is worn away, the diameter of the separation roller 31 becomes small. That is, the tangential force F1 becomes large. In other words, the contacting pressure between the take-out roller 30 and the separation roller 31 and the tangential force of the separation roller 31 increase against the optimum values set using new rollers. In the state shown in FIG. 6 explaining the principle of separation, the separation roller 31 should originally rotate banknotes P in the conveying direction as shown in FIG. 4. However, as a result of this change in separation conditions, the number of rotations decreases and finally, could not rotate and the reversing and stopping are repeated. Thus, when the banknote P1 is taken out, the number of rotations of the separation roller 31 generating a slip friction with increases and the abrasion of the separation roller 31 progresses at an accelerating pace. The fact that the more the separation roller 31 is worn away progressively, the more the contacting pressure with the take-out roller 30 decreases means that it becomes hard for the separation roller 31 to rotate in the state shown in FIG. 4 explained the principle of separation. This will result in the phenomenon that the take-out of banknote P is delayed and a pitch between the taken-out banknotes becomes wide and the number of sheets processed in a unit time decreases. Finally, when the tangential force F1 increases to a level that it is not possible to rotate banknotes, it becomes impossible to take out banknotes.

So, as stated above, when the change in the diameter of the separation roller 31 is detected by resolutions at plural stages through the swing arm 59 and the detectors 91 and 92, a driving current value of the reverse motor 64, that is, the reverse torque to be given to the separation roller 31 is given from the prepared control data table so as to obtain the same tangential force F1 as the corresponding separation condition of a new product is obtained, it becomes possible to take out banknotes one by one stably and certainly for an extended period.

Further, in the first embodiment shown above, two detectors are used for detecting the position of the swing arm. The present invention is not limited to this but the resolutions for detecting change of diameter of the separation roller can be made more fine by increasing the number of detectors. The more the resolution is increased, the more the driving current value of the reverse motor can be set precisely and therefore, the separating state can be more stabilized.

Further, as an alarm is given to the operation portion when the limit position for the swing of the swing arm, that is, the diameter change limit (the abrasion limit) of the separation rollers is detected, it is possible to inform operator of an exchange period of the separation rollers.

Further, in the above-stated first embodiment, the swing arm 59 is adopted as a supporting member of the separation roller 31. However, for example, a horizontal lever that moves horizontally is usable if it moves following the change in the diameter of the separation roller.

Next, a second embodiment of the present invention will be explained.

Further, the illustration and explanation of the same portions as those in the first embodiment will be omitted and different portions only will be shown and explained.

Figure 12:
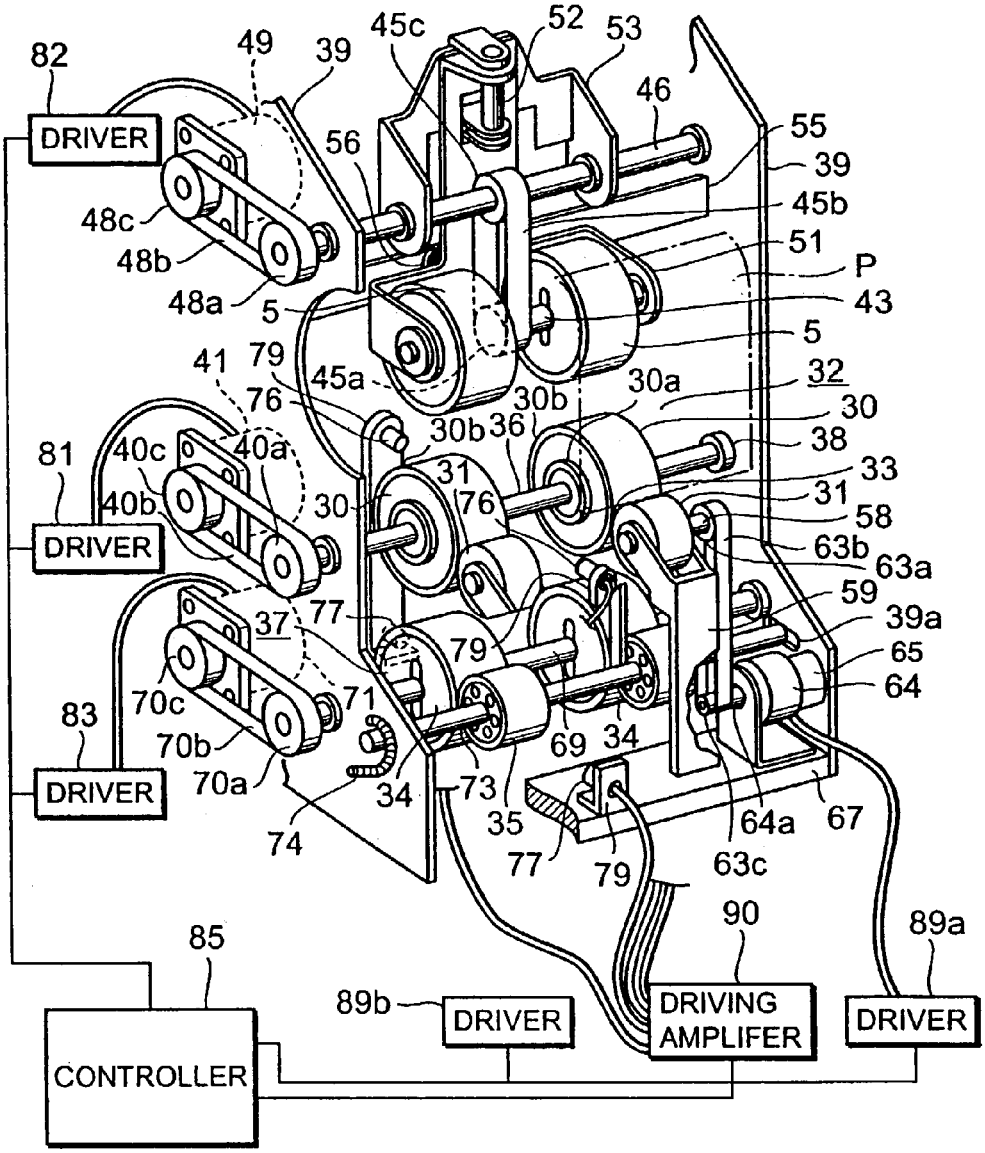
FIG. 12 is a perspective view showing the detailed construction of a banknote take-out apparatus in a second embodiment of the present invention.

FIG. 12 shows the construction of a banknote take-out apparatus that is a sheet take-out apparatus involved in the second embodiment. This banknote take-out apparatus is constructed from the pickup rollers 5 and 5, the separation portion 32 and the conveying portion 37 likewise the above-stated first embodiment. These pickup rollers 5 and 5, the separation portion 32 and the conveying portion 37 are arranged in the vertical direction.

The separation portion 32 is provided with the take-out rollers and 30. The separation rollers (the reverse rollers) 31 and 31 are pushed against the take-out rollers 30 and 30. The conveying portion 37 is located below the take-out rollers 30 and 30 and equipped with driver rollers 34 and 34 that are conveying rollers. The driver rollers 34 and 34 are in contact with pinch rollers 35 and that are conveying rollers. Banknotes P are pulled out and conveyed by the driver rollers 34 and 34 and the pinch rollers 35 and 35. One each of the pickup roller 5, the take-out roller 30, the separation roller 31, the driver roller 34 and the pinch roller 35 are provided at the left and right sides, respectively and banknotes P are taken out along the shorter direction.

A rubber layer 36*b* is formed on the peripheral surfaces of the take-out rollers 30 of the separation portion 32. The take-out rollers 30 are attached to the shaft 36 through the one-way clutch 30*a*. The take-out rollers 30 are capable of freely rotating in the banknote P take-out direction and reducing resistance when banknotes P are pulled out by the driver rollers 34 and the pinch rollers 35. The shaft 36 is attached to the frames 39 through the bearings 38. To one end of the shaft 36, the take-out motor 41 is connected through the pulley 40*a*, the timing belt 40*b* and the pulley 40*c*.

Further, in the second embodiment, the one-way clutch 30*a* is provided to the take-out roller 30. However, the take-out roller 30 may be fixed to the shaft 36 and the one-way clutch 30*a* is provided to the timing pulley 40*a* so as to be able to rotate between the shaft 36 and the pulley 40*a*.

The shaft 43 of the pickup roller 5 is connected to the shaft 46 through the pulley 45*a*, the timing belt 45*b* and the pulley 45*c*. Both ends of the shaft 46 are supported at the frames 39 and 39. To one end of the shaft 46, the pick-up motor 49 is connected through the pulley 48*a*, the timing belt 48*b* and the pulley 48*c*. The shaft 43 is attached rotatably to the bracket 51, which is in turn attached to the bracket 53 through the shaft 52.

The bracket 53 is attached to the frames 39 and 39 through the shaft 46 so that it is enabled to rotate to the left and right. Between the bracket 51 and the stay 55, a compression spring 56 is provided. Thus, the pickup rollers 5 and 5 slightly change the positions to generate a uniform pushing force to the left and right against banknotes P.

The entire circumference of the separation roller 31 is formed with a rubber. The rollers with a friction coefficient to banknotes P higher than a friction coefficient between banknotes P are used. The separation roller 31 is mounted rotatably on the top of the swing arm 59 through the shaft 58. The middle portion of the swing arm 59 is supported rotatably by the shaft 60 (not illustrated) that is a supporting portion. The swing arm 59 is biased by a spring 62 (not illustrated) and pushes the separation roller 31 against the take-out roller 30.

The shaft 58 of the separation roller 31 is connected with a drive shaft 64*a* of a reverse motor 64 through a pulley 63*a*, a timing belt 63*b* and a pulley 63*c*. Thus, the reverse motor 64 is rotated in the direction reverse to the take-out direction of banknotes P. As stated later, the separation roller 31 rotates in the take-out direction with the rotation of the take-out roller 30. The reverse torque is always applied in the reverse direction and a separation force is generated to banknotes P.

The drive shaft 64*a* of the reverse motor 64 is provided with an encoder 65 that is a number of revolutions detecting means for detecting a number of revolutions (that is, the number of revolutions of the separation roller 31) of the drive shaft 64*a*.

The pitch diameter of the timing pulley 63*a* fixed to the shaft 58 of the separation roller 31 is the same as that of the timing pulley 63*c* attached to the drive shaft 64*a* of the reverse motor 64. Further, the reverse motor 64 is fixed to a stay 67 so that the shaft center of the shaft 60 of the swing arm 59 is positioned on the shaft center of the drive shaft 64*a*.

The driver rollers 34 are supported at the frames 39 and 39 through the shaft 69. The shaft 69 is connected to a conveyor motor 71 through the pulley 70*a*, the timing belt 70*b* and the pulley 70*c*. The pinch rollers 35 are rotatably supported at a shaft 73. Both ends of the shaft 73 are supported by a horizontal slit 39*a* of the frames 39 and 39 and compressed by a spring 74. By this compression, the pinch rollers 35 are pressed against the driver rollers 34 and generate the conveying force.

Among the take-out rollers 30, the driver rollers 34 and the pinch rollers 35, a first detector 76 is provided, which is a detecting means to detect banknotes P sent out by the take-out rollers 30 and the separation rollers 31. Near the carry-out side of the driver roller 34 and the pinch roller 35, there is provided a second detector 77 that is a second detecting means to detect banknotes P sent out by the driver rollers 34 and the pinch rollers 35. The first and second detectors 76 and 77 are, for example, light transmission type sensors and attached to a bracket 79, respectively. Further, near the pickup rollers 5 of the banknote supply portion 2, a third optical detector 75 is provided to detect whether there are banknotes P in the banknote supply portion 2.

The optical axis of the first detector 76 passes through the conveying path between the contacting portion of the take-out roller 30 with the separation roller 31 and the contacting portion of the driver roller 34 with the pinch roller 35. The optical axis of the second detector 77 passes through the conveyor path immediately after the contacting portion of the driver roller 34 with the pinch roller 35.

Drivers 81, 82 and 83 are connected to the take-out motor 41, the pick-up 49 and the conveyor motor 71, respectively. These drivers 81, 82 and 83 are connected to a controller 85, respectively. Further, the intermittent drive control is required for the take-out motor 41 and the pick-up motor 49 and a pulse motor is used for this purpose.

Drivers 89*a* and 89*b* are connected to the left and right reverse motors 64, respectively. The drivers 89*a* and 89*b* are connected to the controller 85 that is a control means of these drivers. The reverse motor 64 is a DC motor capable of controlling driving current and a required generating torque is obtained by setting a driving current value. A driving amplifier 90 is connected to the first and second detectors 76 and 77, and detects the passage of banknotes P and sends this information to the controller 85.

Further, the principle of generating separation force in the separation portion 32 is the same as that described in the first embodiment and therefore, the explanation thereof will be omitted here.

Figure 13:
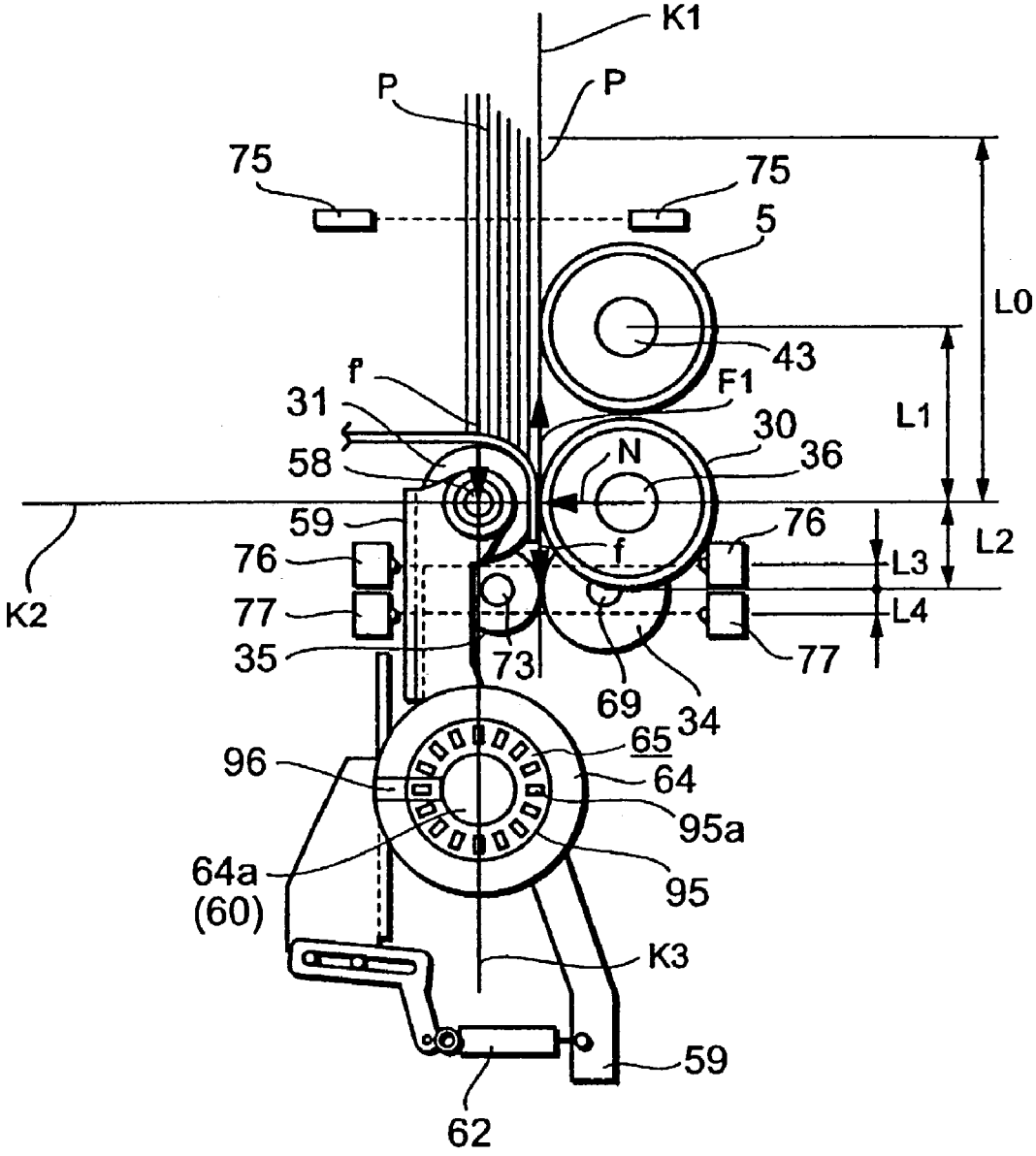
FIG. 13 is a side view showing the details of an encoder and the arrangement of the rollers in the banknote take-out apparatus in the second embodiment.

FIG. 13 shows the details of the encoder 65 and the layout of the rollers in the banknote take-out apparatus.

As stated above, the separation roller 31 is mounted rotatably on the top of the swing arm 59 through the shaft 58. The middle portion of the swing arm 59 is supported rotatably by the shaft 60 that is a supporting portion located on the same straight line as the center of the rotary shaft of the separation roller 31. The swing arm 59 is biased by the spring 62 and pushes the separation roller 31 against the take-out roller 30.

The encoder 65 is attached to the drive shaft 64*a* of the reverse motor 64 on the same axis of the shaft 60 as stated above. That is, the encoder 65 is composed of a disc shape slit plate 95 fixed to the drive shaft 64*a* of the reverse motor 64 and a detector 96 to optically detect many slit holes 95*a* provided at a definite space on the periphery portion of the slit plate.

Thus, by providing the encoder 65, it becomes possible to detect the number of revolutions of the drive shaft 64*a* of the reverse motor 64. The shaft 58 of the separation roller 31 is connected to the drive shaft 64*a* of the reverse motor 64 through the pulley 63*a*, the timing belt 63*b* and the pulley 63*c* as shown in FIG. 2. Therefore, the detection of the number of revolutions of the drive shaft 64 does mean to detect the number of revolutions of the shaft 58 of the separation roller 31.

In the state to take out sheets P shown in FIG. 4, there is one sheet P between the take-out roller 30 and the separation roller 31 and the separation roller 31 is rotating in the conveying direction. At this time, assuming that the speed to take out one sheet P is V [m/s], the radius of the separation roller 31 is r [mm] and the number of revolutions of the separation roller 31 is N[rpm], the take-out velocity V is expressed by the following formula:

$$v=2\pi r\times 10^{-3}\times N/60$$

When the separation roller 31 is worn away, the radius r decreases. As the take-out velocity V is constant, the number of revolutions N of the rotating separation roller 31 increases. That is, when the diameter of the separation roller 31 changes, the number of revolutions of the separation roller 31 will change.

Thus, the change in the diameter of the separation roller 31 can be detected by detecting the change in the number of revolutions of the separation roller 31. Then, when a control data table shown in FIG. 8 is prepared, optimum drive current values of the motor 64 at respective stages of the diameters of the separation roller 31 are determined in advance. And when an optimum drive current is supplied from the control data table corresponding to the detection result of the detector 96, an optimum separation condition can be maintained even when the diameter of the separation roller 31 is changed. In other words, even if the separation roller 31 is worn away, it becomes possible to take out sheets one by one stably and certainly for an extended period by changing the reverse torque of the separation roller 31.

Figure 14:
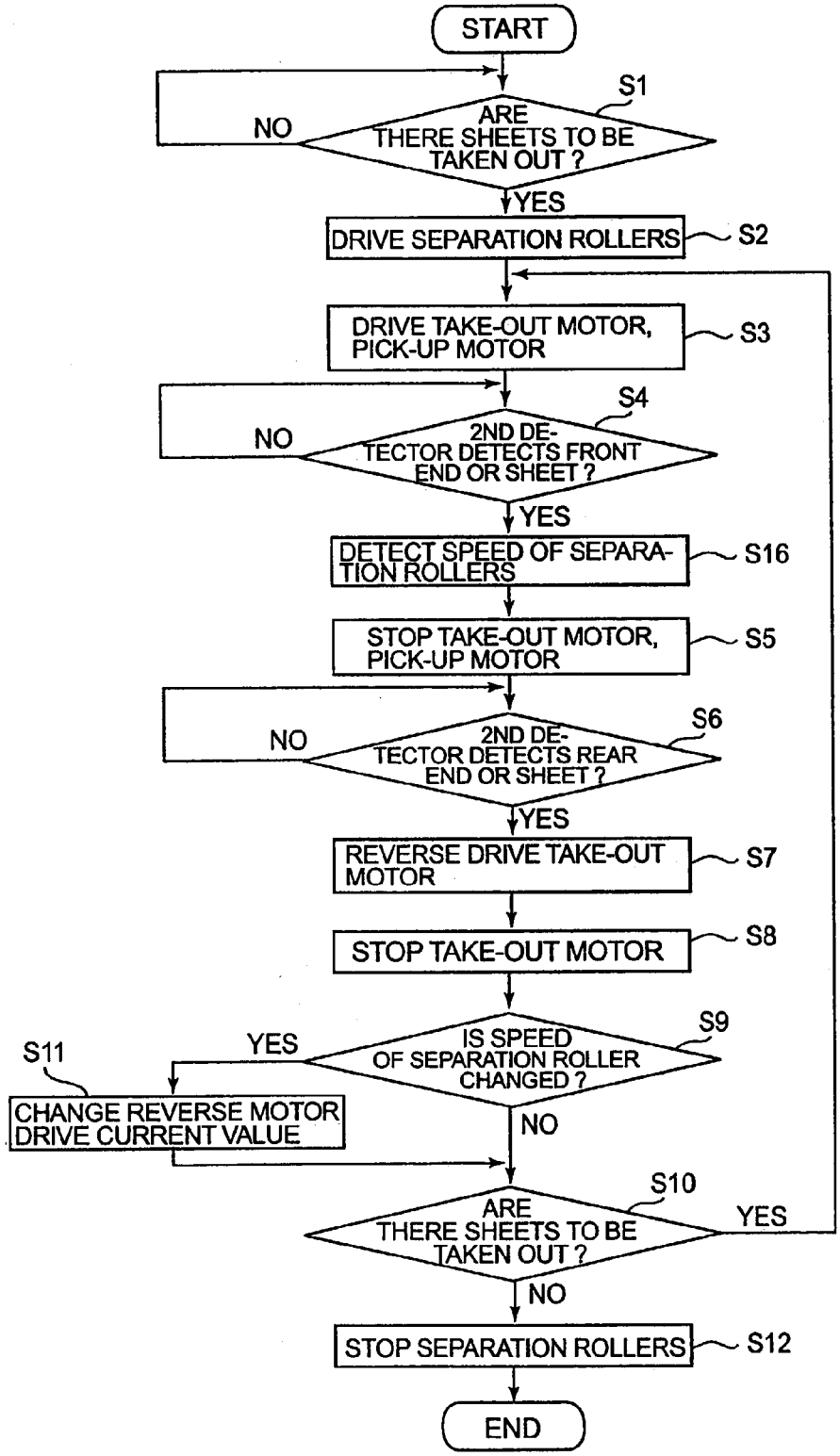
FIG. 14 is a flowchart for explaining the banknote take-out operation in the second embodiment.

Next, in the above-stated construction, the banknote take-out operation will be explained referring to a flowchart shown in FIG. 14. When the take-out of banknotes P starts, it is discriminated as to whether there are banknotes P to be taken out in banknote supply portion 2 based on the output signal from the third detector 75 (Step S1). As a result of this discrimination, when there are banknotes P, the separation roller 31 is driven to rotate in the reverse direction by the reverse motor 64 (Step S2). At this time, the take-out roller 30 is kept stopped and therefore, the separation roller 31 does not rotate according to a resisting force received from the take-out roller 30. Thereafter, the take-out motor 41 and the pick-up motor 49 are driven to rotate (Step S3) and the banknote P take-out starts.

Then, the controller 85 discriminates whether the front end of a taken-out first banknote P passes through the take-out roller 30 and is detected by the second detector 77 (Step S4). When the second detector 77 detects the front end of the first banknote P, the controller 85 detects the number of revolutions of the separation roller 31 based on the output signal from the detector 96 comprising the encoder 65 (Step S16). This detected number of revolutions is stored in a memory (not illustrated).

Then, the controller 85 stops the take-out motor 41 and the pick-up motor 49 to run (Step S5). As the take-out motor 30 has the built-in one-way clutch 30*a*, even when the take-out motor 41 is stopped, the take-out roller 41 rotates jointly with a banknote P conveyed by the driver roller 34 and does not give resistance to a first banknote P. When after the front end of the first banknote P reaches the second detector 77, the rear end of the banknote P comes off the pickup roller 5.

Further, when banknotes P are long and the rear end of a first banknote P is still on the pickup roller 5, it acts on the first sheet of banknote P as resistance. However, as the pushing pressure of the driver roller 34 and the pinch roller 35 is set larger than the pushing pressure on the pickup roller 5 to the banknotes P, the banknote P is conveyed by slipping on the pickup roller 5. When the first banknote P comes off the pickup roller 5 and the second banknote P comes to contact the pickup roller 5, the pickup roller 5 acts as a brake to the second ban P and prevents the banknotes P from being taken out.

Then, the controller 85 discriminates whether the second detector 77 detects the rear end of the first banknote P being conveyed (Step S6). When the second detector 77 detects the rear end of the first banknote P, the controller 85 drives the take-out motor 41 in the reverse direction (Step S7). At this time, as the take-out motor 30 is attached to the shaft 36 through the one-way clutch 30*a*, the take-out roller 30 is rotated in the reverse direction by a friction force with the separation roller 31 that is rotating in the reverse direction. That is, both the take-out roller 30 and the separation roller 31 are rotated in the reverse direction.

At this time, the controller 85 control the drive of the take-out motor 41 to rotate the take-out roller 30 by a prescribed angle, that is, an angle that cannot divide 360°, for example, 7°. With the rotation of the take-out roller 30, the separation roller 31 is also rotated by the prescribed angle.

Thus, it becomes possible to prevent the one-sided abrasion of the separation roller 21 by rotating it by the prescribed angle that cannot divide 360° and the stabilized separation operation is enabled for an extended period.

The controller 85 stops the drive of the take-out motor 41 after rotating the take-out roller 30 by a prescribed able by controlling the drive of the take-out motor 41 (Step S8).

Then, the controller 85 checks whether there is a change in the number of revolutions of the separation roller 31 by comparing the number of revolutions of the separation roller 31 detected this time in Step S16 with the number of revolutions of the separation roller 31 detected previously and stored in a memory (not shown) (Step S9).

If there is no change in the number of revolutions of the separation roller 31 as a result of the discrimination, the operation proceeds to Step S10. When there is a change, the controller 85 changes the drive current value of the reverse motor 64 to an optimum value (Step S11) and the operation proceeds to Step S10. Further, the method for changing the drive current value of the reverse motor 64 in Step S11 can be the same as that explained in the first embodiment using the control data table shown in FIG. 8.

Now, in Step S10, the controller 85 discriminates if there are banknotes P in the banknote supply portion 2 based on the output signal from the third detector 75. When it is discriminated that there are banknotes P as a result of the discrimination, return to Step S3 and start to take out a second banknote P. Further, when it is judged that there is no banknote P, the separation roller 31 (the reverse motor 64) is stopped (Step S12). Thereafter, all motors are stopped and the take-out operation is terminated.

Thus, detecting the number of revolutions of the separation roller 31 (detecting the diameter of the separation roller 31) after taking out one sheet of banknote P, proceed to the next banknote take-out step if the number of revolutions (the diameter) was not changed. If the number of revolutions of the separation roller 31 was changed, changing the driving current value of the reverse motor 64 to the preset driving current value according to the number of revolutions, proceed to the next banknote take-out step.

Figure 15:
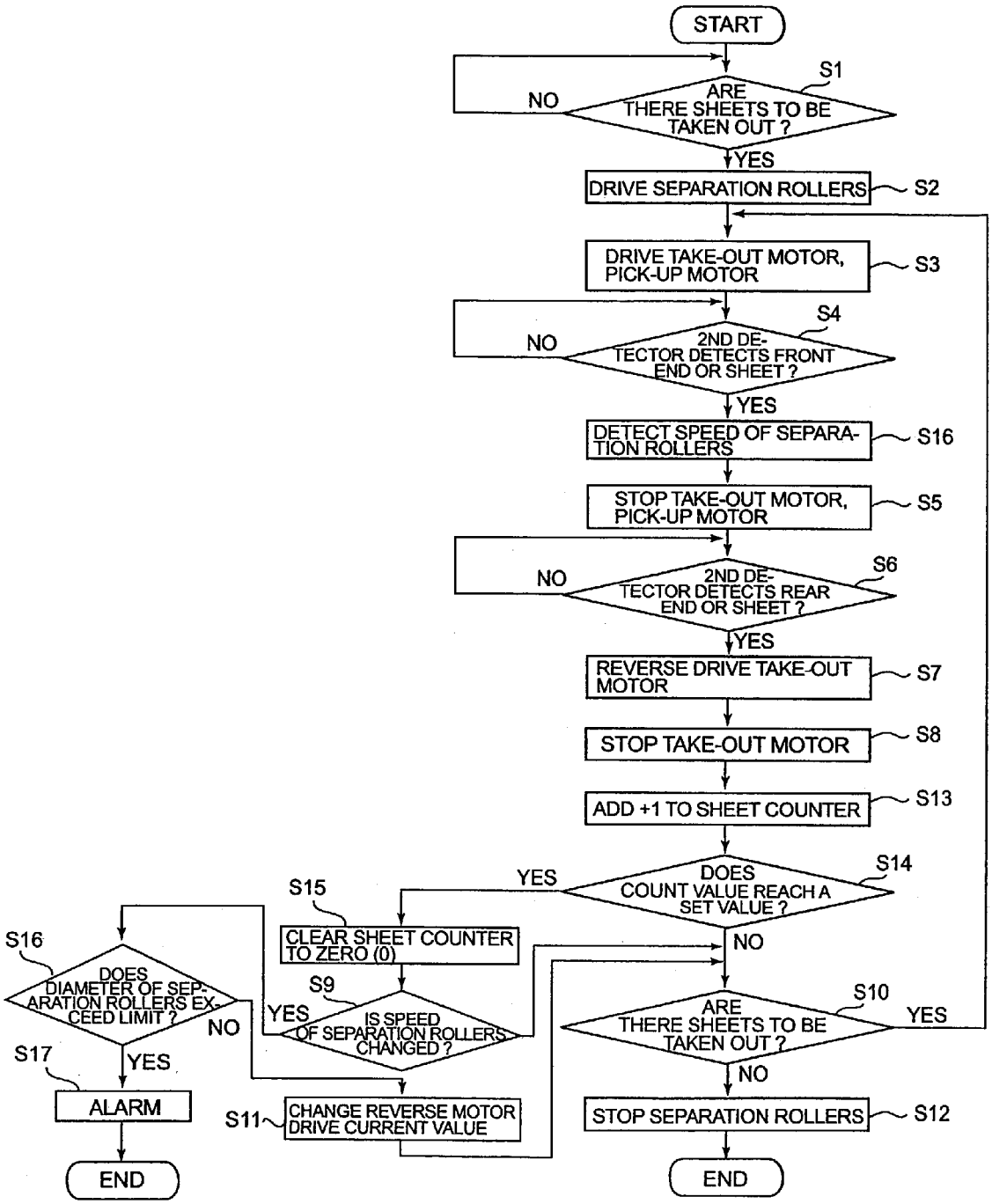
Figures 16A, 16B, 16C, 16D:
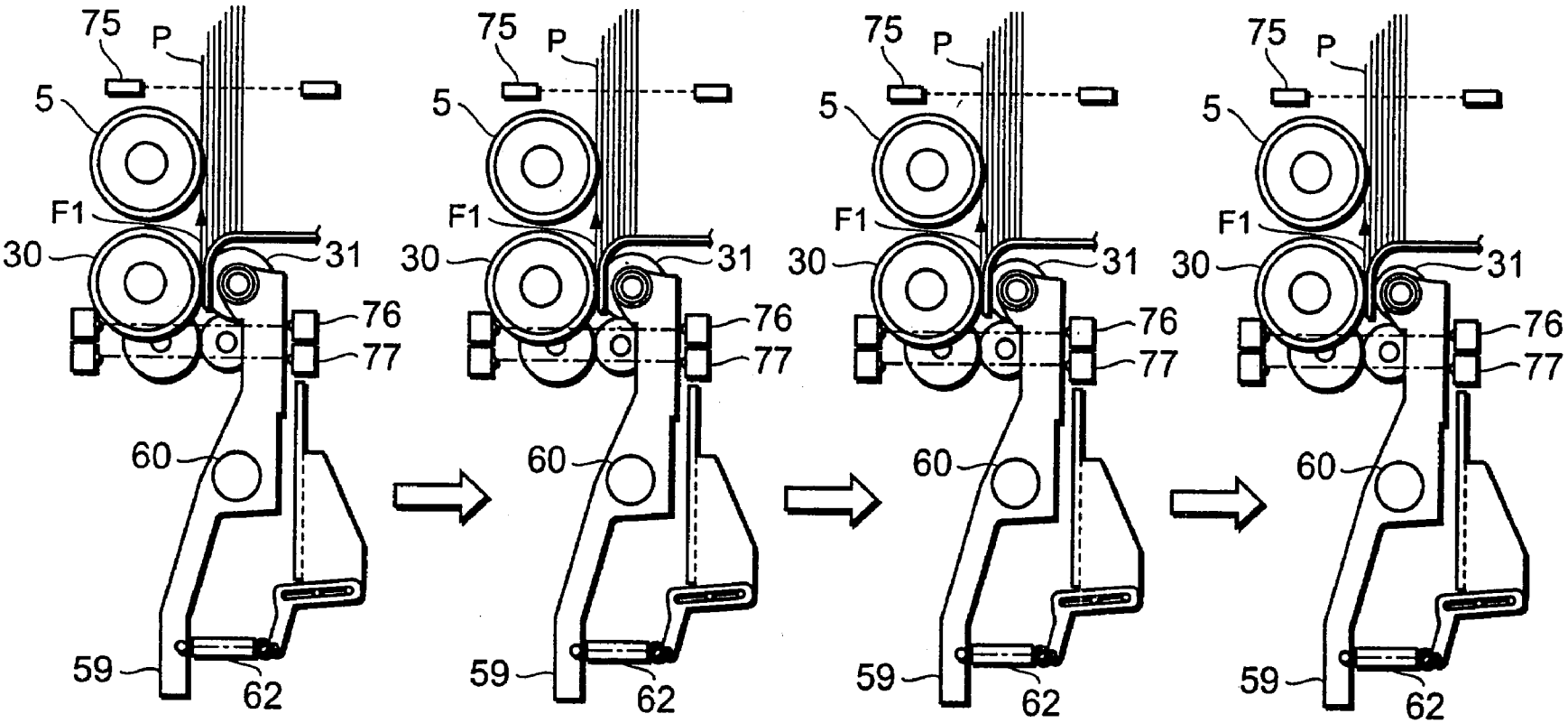
FIG. 16A–FIG. 16D are side views showing the diameter change state of the separation rollers in the second embodiment.

Further, it is unnecessary to detect the number of revolutions of the separation roller 31 every time when one sheet of banknote P is taken out but the detection can be made whenever preset prescribed number of sheets are taken out. In this case, the banknote take-out operation will become as shown in a flowchart in FIG. 15. The flowchart shown in FIG. 15 differs from the flowchart 14 show in FIG. 14 in that the processes in Steps S13–S15 are added between the steps S8 and S9 and all others are the same as FIG. 14. The processes in Step S13–S15 will be explained below.

In Step S13, add ⌈+1⌋ to a sheet counter (not illustrated) that is a means to count the number of sheets of banknote P taken out. In Step S14, discriminating whether a count value of the number of sheet counter becomes a preset prescribed value, proceed to Step S10 if the count value is not the prescribed value and proceed to Step S15 if the count value is the prescribed value. In Step S15, after clearing the number of sheet counter to "0", proceed to Step S9.

By the above-stated operations, it is possible to detect the number of revolutions (the diameter) of the separation roller 31 whenever the preset prescribed number of sheets of banknote P are taken out.

Further, when the number of revolutions of the separation roller 31 is changed in Step S9, the diameter of the separation roller 31 is checked if it exceeds the limit in Step S16. As a result of this check, if the diameter reached the limit, proceed to Step S17. For example, when the diameter of the separation roller 31 reaches 21 mm as shown in the control data table in FIG. 8, it is regarded the function as the separation roller 31 reaches the limit by abrasion and an alarm is given to operator in Step S17.

Further, when the number of revolutions of the separation roller 31 is not changed in Step S9, proceed to Step S10.

As explained above, according to the above-mentioned second embodiment, even when the diameter of the separation roller 31 for abrasion and the like, banknotes P can be taken out one by one stably and certainly for an extended period.

In other words, even when the one-sided abrasion of the reverse roller 31 can be prevented, abrasion of the reverse roller 31 cannot be eliminated and therefore, with the progress of abrasion, the diameter of the reverse roller 31 becomes small. The layout of rollers when the diameter of the separation roller 31 decreased are shown in FIG. 16A–FIG. 16D. Number of revolutions of the separation roller 31 increases by an amount of decreased diameter of the separation roller 31.

As the result, the contacting pressure between the take-out roller 30 and the separation roller 31 decreases by an amount of decreased amounting length of the spring 62. Further, a torque generated on the separation roller 31 is given from a torque of the reverse motor 64 connected thereto through the timing belt 63*b*. Accordingly, the tangential force F1 in the reverse direction at the point of the separation roller 31 contacting the take-out roller 30 will be $$F1=T\,e/a$$

where, T is a torque of the reverse motor 64, e is a pitch radius of the timing pulley 63*c* and a is a pitch radius of the separation roller 31.

From the above formula, when the separation roller 31 is worn away, the diameter of the separation roller 31 becomes small. That is, the tangential force F1 becomes large. In other words, against an optimum set value using new roller, the contact pressure between the take-out roller 30 and the separation roller 31 decreases and the tangential force of the separation roller 32 increases. By this change in the separation condition, in the state shown in FIG. 6 explaining the principle of separation, the separation roller 31 should originally takes banknotes P in the conveying direction as shown in FIG. 4. However, the number of rotations to take out banknotes P decreases and finally couldn't to rotate and the reverse and stop operations would be repeated. As a result, when a banknote P1 is taken out, the number of slip frictions caused with the separation roller 31 increase and abrasion of the separation roller 31 will progress at an accelerated pace.

The more the abrasion of the separation roller 31 progresses, the more the contact pressure with take-out roller decreases and the tangential force F1 increases. This means that the separation roller 31 will become difficult to rotate in the state shown in FIG. 4 explaining the principle of separation. This will result in a phenomenon that the take-out of banknotes P is delayed and a pitch between banknotes becomes wide, and the number of banknotes processed in unit time decreases. When the tangential force F1 increases to the state wherein the rotation is not possible, the banknote take-out will become impossible.

So, as described above, by detecting the number of revolutions of the separation roller 31 by the encoder 65, changes in the diameter of the separation roller 31 are detected using resolutions at plural stages. Then, a drive current value of the reverse motor 64, that is, a reverse torque to be given to the separation roller 31 is given from data on the preset control data table so that the same tangential force F1 as the separation conditions of new products is obtained. Thus, it is enabled to take out banknotes one by one stably and certainly for an extended period.

Further, the revolutions to detect changes in the number of revolutions of the separation roller 31 can be made more fine by increasing the number of slit holes 95*a* of the slit plate 95 comprising the encoder 65. With the increase of resolutions, the more finely the driving current values of the reverse motor 64 can be set more finely, and the separation state can be more stabilized.

Further, when the limit for the number of revolutions of the separation roller 31, that is, the limit for changes in the diameter of the separation roller 31 (the abrasion limit) is detected, an alarm is output to the operation portion. As a result, it becomes possible to inform operator of an exchange period of the separation roller 31.

Further, in the second embodiment described above, the detection of the number of revolutions of the separation roller 31 by detecting the number of revolutions of the drive shaft 64*a* of the reverse motor 64 is explained. However, the present invention is not limited to this practice but it is also applicable to directly detect the number of revolutions of the separation roller 31 by the encoder 65. In this case, for example, it is advisable to install the encoder 65 to the shaft 58 of the separation roller 31.

As described above, according to the present invention, a sheet take-out apparatus capable of taking out sheets one by one stably and certainly for an extended period can be provided.

What is claimed is:

1. A sheet take-out apparatus comprising:

a pickup roller to send out sheets;

a take-out roller to take out the sheets sent out by the pickup roller;

a separation roller that provides pressure to the take-out roller and separates the sheets one by one by rotating torque in the direction reverse to the take-out direction of the sheets;

a sensor to detect a presence or absence of sheets at a downstream location, with respect to said pick-up roller and said take-out roller, alone a path followed by the sheets in the sheet take-out apparatus;

a support member to support the separation roller and to move according to a change in diameter of the separation roller;

a detector to detect a position of the support member moving in accordance with the change in diameter of the separation roller when the sensor detects the absence of sheets; and a controller to reduce rotating torque of the separation roller when the support member moves in accordance with the detection result of the detector.

2. The sheet take-out apparatus according to claim 1, wherein the support member includes a swing arm.

3. The sheet take-out apparatus according to claim 2, wherein the detector detects the movement of the swing arm at plural stages, and the controller controls to reduce rotation torque of the separation roller at the plural stages according to the movement of the swing arm detected by the detector at the plural stages.

4. The sheet take-out apparatus according to claim 1, further comprising:

a motor to apply a rotating torque to the separation roller in the direction reverse to the sheet take-out direction, wherein the controller controls the rotating torque to be applied to the separation roller by varying drive current of the motor according to the result of detection of the detector.

5. The sheet take-out apparatus according to claim 4, wherein the controller has a control data table storing motor drive current values that are optimum for the diameters of the separation roller, takes out a motor drive current value corresponding to the detection result of the detector from the control data table and sets up this drive current value taken out as a motor drive current value.

6. The sheet take-out apparatus according to claim 1, further comprising:

a counter to count the number of sheets taken out by the take-out roller, wherein the detector detects movement of the support member whenever the count value of the counter reaches a prescribed value.

7. The sheet take-out apparatus according to claim 1, further comprising an alarm to inform operator of an exchange period of the separation roller when the detector detects the moving limit position of the support member.

8. A sheet take-out apparatus comprising:

a pickup roller to send out sheets;

a take-out roller to take out the sheets sent out by the pickup roller;

a separation roller that provides pressure to the take-out roller and separates the sheets one by one by rotating torque in the direction reverse to the take-out direction of the sheets;

a sensor to detect a presence or absence of sheets at a downstream location, with respect to said pick-up roller and said take-out roller, along a path followed by the sheets in the sheet take-out apparatus;

a number of rotations detector to detect the number of rotations of the separation roller when the sensor detects the absence of sheets; and a controller to reduce the rotating torque of the separation roller when the number of rotations detector changes in accordance with the detection result of the number of rotations detector.

9. The sheet take-out apparatus according to claim 8, wherein the controller controls rotating torque of the separation roller at the plural stages according to the number of rotations of the separation roller detected by the number of rotations detector.

10. The sheet take-out apparatus according to claim 8, further comprising:

a motor to apply rotating torque to the separation roller in the direction reverse to the sheet take-out direction, wherein the controller controls rotating torque to be applied to the separation roller by varying the drive current of the motor according to the detection result of the number of rotations detector.

11. The sheet take-out apparatus according to claim 10, wherein the controller has a control data table containing drive current values of the motor optimum to the number of rotations of the separation roller, takes out the drive current value of the motor for the number of rotations of the separation roller corresponding to the detection result and sets this drive current value as a drive current value of the motor.

12. The sheet take-out apparatus according to claim 8, further comprising:

a counter to count the number of sheets taken out by the take-out roller, wherein the number of rotations detector detects the number of rotations of the separation roller whenever the count value of the counter reaches a preset prescribed value.

13. The sheet take-out apparatus according to claim 8, further comprising an alarm to inform operator of an exchange period of the separation roller when the number of rotations detector detects the number of limit of the separation roller.

14. A sheet take-out method in a sheet take-out apparatus that has a pickup roller to send out sheets, a take-out roller to take out the sheets sent out by the pickup roller, and a separation roller providing pressure to the take-out roller and separating the sheets one by one by rotating torque in the direction reverse to the take-out direction of the sheets, comprising:

detecting with a sensor a presence or absence of sheets at a downstream location, with respect to said pick-up roller and said take-out roller, along a path followed by the sheets in the sheet take-out apparatus;

detecting a diameter size of the separation roller that changes with abrasion when the sensor detects the absence of sheets; and reducing the rotation torque of the separation roller when the diameter size of the separation roller changes in accordance with the detection result in the detecting.

15. The sheet take-out method according to claim 14, wherein the detecting is carried out at plural stages, and the reducing reduces the rotating torque of the separation roller at plural stages according to the detection results at the plural stages.

16. The sheet take-out method according to claim 14, further comprising:

applying the rotating torque with a motor in the direction reverse to the take-out direction to the separation roller, wherein the reducing changes the drive current supplied to the motor according to the detection result of the diameter size.

17. The sheet take-out method according to claim 16, wherein the reducing takes out a motor drive current value from a control data table storing motor drive current values that are optimum for the diameters of the separation roller and supplies a drive current corresponding to the motor drive current value taken out from the control data table to the motor.

18. The sheet take-out method according to claim 14, further comprising:

counting the sheets taken out by the take-out roller, wherein the detecting detects a size of the diameter of the separation roller whenever the counted value reaches a preset prescribed value.

19. The sheet take-out method according to claim 14, further comprising:

alarming operator of an exchange period of the separation rollers when the limit value of diameter size for abrasion of the separation rollers is detected in the detecting.

* * * * *